United States Patent [19]

Satterthwaite

[11] 3,974,611

[45] Aug. 17, 1976

[54] MODULAR ARCHITECTURAL EDUCATIONAL TOY AND PLAYGROUND ERECTOR-SET AND BUILDING SYSTEM

[76] Inventor: Edward W. Satterthwaite, 418 S. Hutchinson St., Philadelphia, Pa. 19147

[22] Filed: Mar. 26, 1973

[21] Appl. No.: 345,217

[52] U.S. Cl. ..... 52/309; 46/25; 52/591; 52/594; 52/648; 52/DIG. 10; 272/110

[51] Int. Cl.[2] ..... E04C 1/10

[58] Field of Search ..... 52/DIG. 10, 591, 593, 52/594, 309, 648; 46/25, 26, 28; 272/60 R

[56] References Cited

UNITED STATES PATENTS

| | | | |
|---|---|---|---|
| 2,061,510 | 11/1936 | Drumpelmann | 52/DIG. 10 |
| 2,839,841 | 6/1958 | Berry | 52/DIG. 10 |
| 3,229,439 | 1/1966 | Strobel | 52/591 |
| 3,611,617 | 10/1971 | Foster et al. | 52/DIG. 10 |
| 3,632,109 | 1/1972 | Dattner | 52/DIG. 10 |
| 3,659,360 | 5/1972 | Zeischegg | 52/DIG. 10 |

FOREIGN PATENTS OR APPLICATIONS

| | | | |
|---|---|---|---|
| 285,490 | 5/1929 | United Kingdom | 52/DIG. 10 |

*Primary Examiner*—Alfred C. Perham
*Attorney, Agent, or Firm*—Leonard L. Kalish

[57] ABSTRACT

A modular educational erector-toy and erector playground equipment and building system for constructing single-level and multi-level toy and playground structures and buildings of widely variable optional combinations of hollow primary tetrahedron modules and secondary tetrahedron and hexahedron modules and tertiary pentahedron and septahedron modules; the modules being full-size, half-size and quarter-size. The modules are bounded by planar walls, with the outer surfaces on one or more walls of each module matching the whole or an integral fraction of the outer surfaces of one or more walls of every other module. Some or all of the walls of the modules have substantial openings or windows therein so as to form planar boundary flanges or webs defining such tetrahedrons, pentahedrons, hexahedrons and septahedrons. The optionally assembled toy and the playground equipment or building is formed by a juxtaposition of matching faces of the modules in registraton and contact with each other and by securing the so juxtaposed modules to each other either by temporary or releasable fastening means (which may be integral or non-integral with the modules) to permit the toy or the playground equipment to be assembled and to be disassembled wholly or in part and to be restructured from time to time in the same or optionally different multi-module structures.

46 Claims, 117 Drawing Figures

P MODULE 5.3"
3"
6"
5.4"
4.3"
5.4"
45°
90°
55°
35°
70°
A
B
C
W
120
129

MODULE S-1

W
B
C
dC
A
120
129
132

MODULE S-2

MODULE S-3

MODULE S-3

MODULE T-1

MODULE T-2

MODULE T-3

MODULE T-3

MODULE T-3

P MODULE
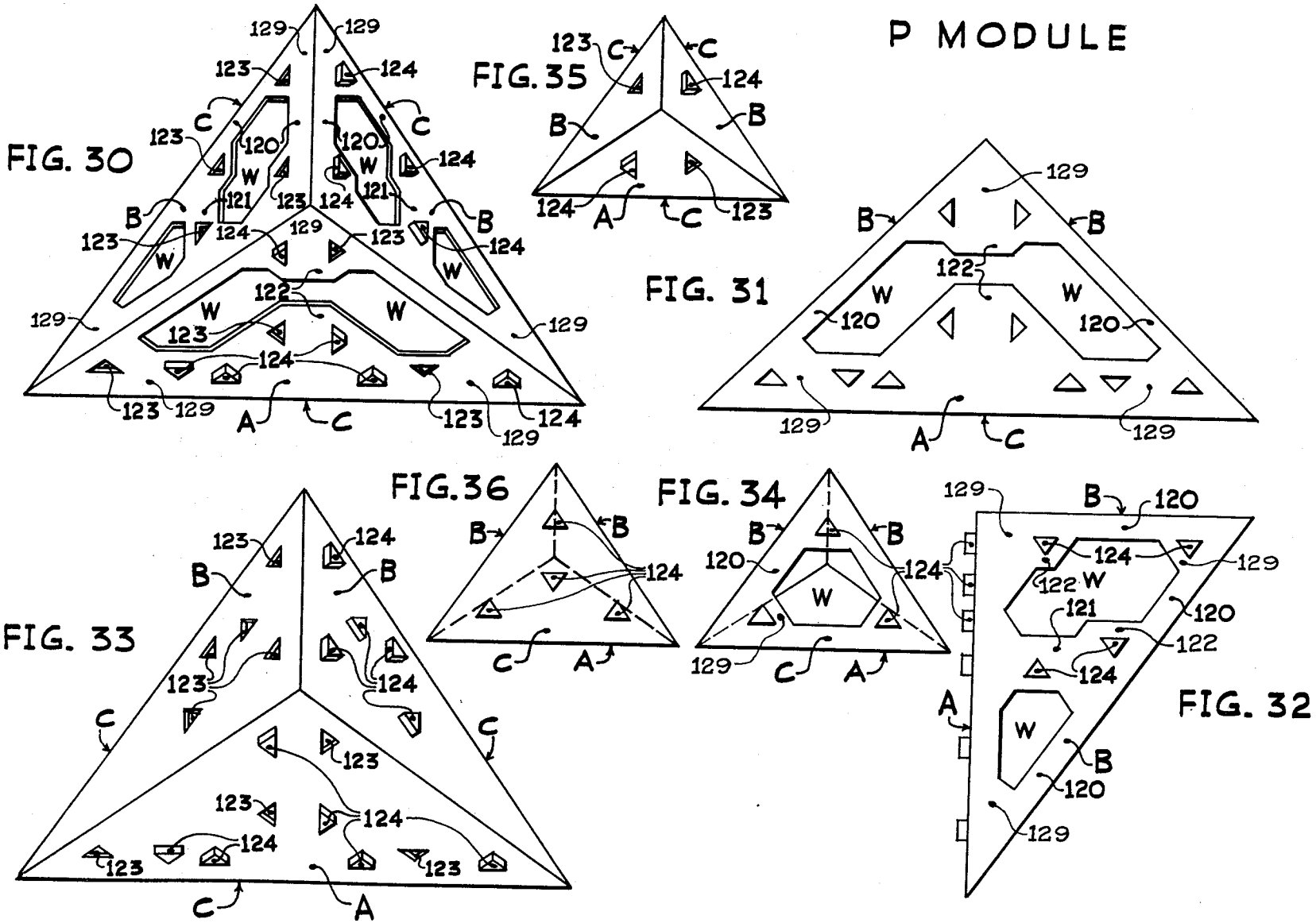

S-1 MODULE

S-1 MODULE

S-1 MODULE

S-2 MODULE

S-2 MODULE

S-2 MODULE

T-1 MODULE

T-1 MODULE

T-1 MODULE

T-2 MODULE

C
C
C
C
G
T-2 MODULE
82
82
C
G
C
C
C

C
122
121
122
C
C
G

T-2 MODULE 85
85
C
G
123
124

TOP FRONT PERSPECTIVE

RIGHT TOP PERSPECTIVE

TOP REAR PERSPECTIVE

TOP PLAN VIEW

REAR ELEVATIONAL VIEW

BOTTOM VIEW

RIGHT END ELEVATIONAL VIEW

FRONT ELEVATION

RIGHT ELEVATION

LEFT ELEVATION

REAR ELEVATION

TOP VIEW

BOTTOM VIEW

S-1
1/2 S-1
T-2
1/2 T-2
UNFENESTRATED WALL
W
120
122
125
126
127
128
129
130
131

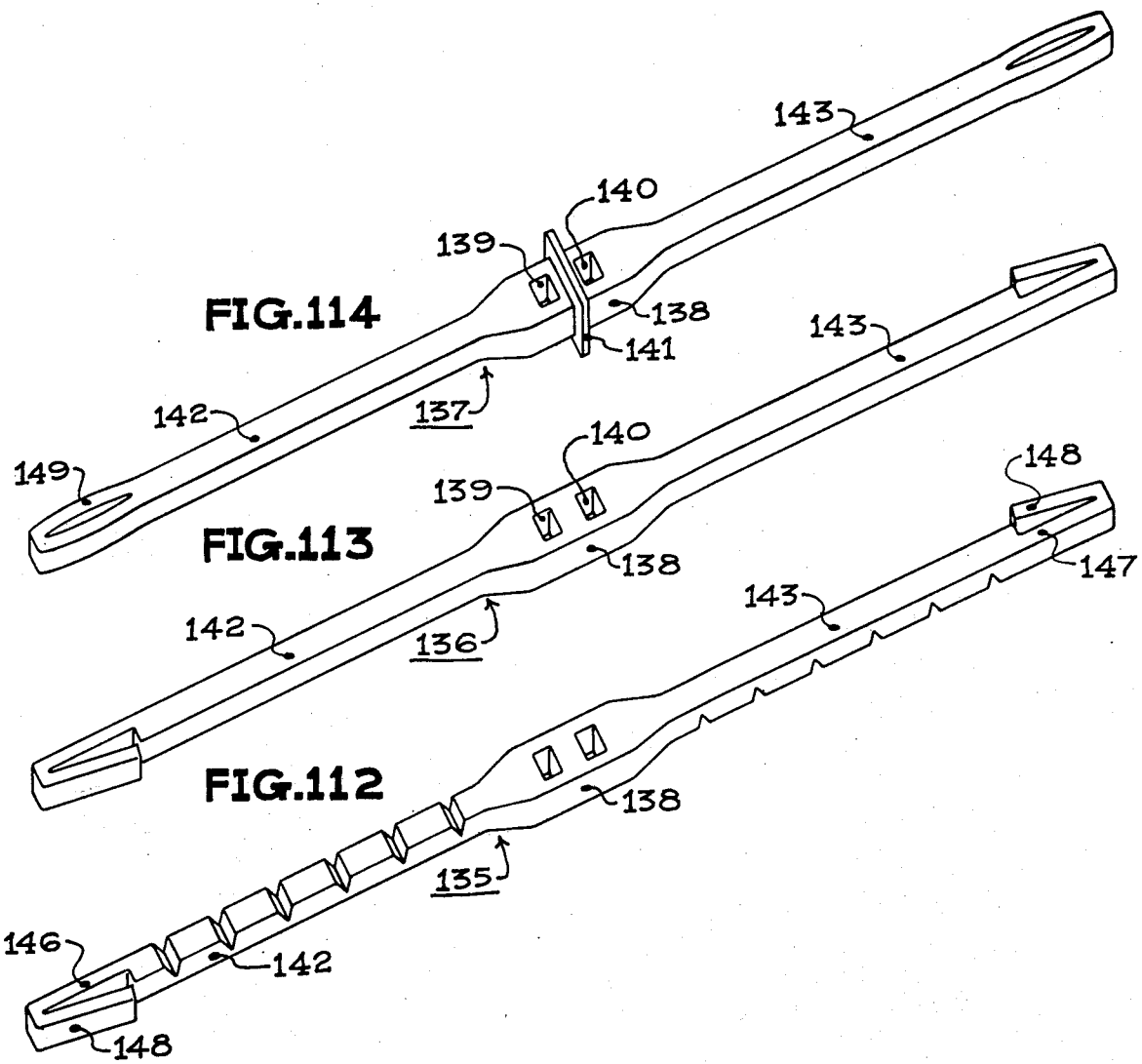
FIG.114
FIG.113
FIG.112
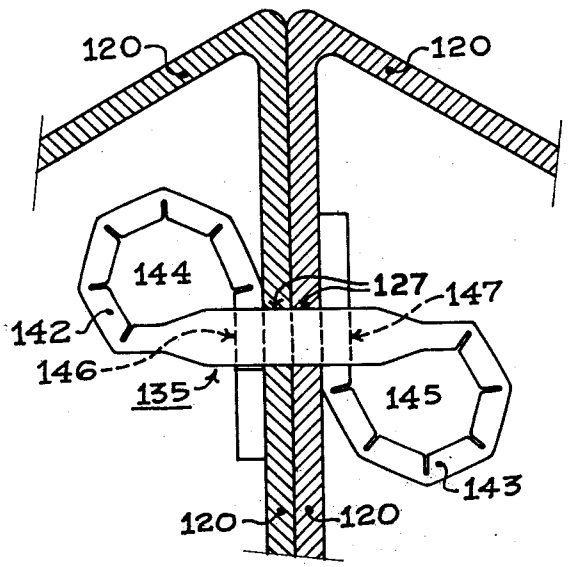
FIG. 111

MODULAR ARCHITECTURAL EDUCATIONAL TOY AND PLAYGROUND ERECTOR-SET AND BUILDING SYSTEM

THE OBJECT OF THE INVENTION

The object of the toy and playground embodiments of my present invention (as distinguished from the habitable-building embodiment thereof) is an educational toy comprising a modular erector-toy structure of relatively small modules and modular playground equipment structure of similar but relatively large modules, which toy and playground equipment has high instructional and educational value and can be assembled and dissassembled by a child without tools or implements or with only minimal tools or implements, and which will effectively educate him in and tend to develop in him, while at play, an understanding and perception of geometric structures and their spacial relationships and geometric relationships and of the construction of composite structures from components thereof, and which will tend to develop his manual dexterity and mechanical aptitude, and which playground equipment will also afford means for physical exercise and can also be used for constructing small-scale utility enclosures for storage, weather pavillion, changeroom or the like.

BRIEF SUMMARY OF THE INVENTION

The aforementioned primary tetrahedron modules, secondary tetrahedron modules and pentahedron modules, and tertiary pentahedron and septahedron modules may be formed of several sizes which are multiples of each other or integral fractional sizes of each other. Thus one size of each of the aforementioned modules may be regarded as the "full-size" module for purposes of reference. Identical modules of half-size, quarter-size and one-eighth size, and also of double-size and 4-times-size are provided, whereby a structure may be extended from a structure composed of larger size modules, and whereby a variety of vertical, angular and horizontal building portions or sections may be optionally formed either individually or in continuation of each other, to constitute either the vertical or angularly upward extending building sections and to constitute floors, walls and ceilings and connecting passageways which may horizontally, vertically or angularly connect sections of the building or successive levels thereof. The upward extending passageways may be vertical or at a 45° angle or at a 30° angle, and may form both the supports as well as staircase spaces and walking ramps or the like.

In the case of the erector-toy, the modules are preferably formed of a suitable, generally form-retaining synthetic-resin plastic of suitable resiliency, and preferably integral fastening means comprising recesses (preferably polygonal in shape) in one or several planar surfaces or walls of the modules and corresponding and registering polygonal projections or knobs (of matching polygonal shape) in one or several of the matching faces of complementary modules, with the recesses and the knobs being so sized in relation to each other that the knobs will fit into the recesses with sufficient interference fit to hold the so interengaged module faces in assembled relation to each other, while also permitting their disengagement, at will; the resiliency of the plastic being such as to permit such inter-engagement between the knobs and the recesses with a suitable interference fit and to permit the disengagement of the knobs from the recesses with a reasonable pull.

In the case of the erector playground equipment, the modules are preferably formed of a suitable generally form-retaining, light-weight, fire-resistant and impact-resistant synthetic-resin plastic having a suitable slight resiliency and preferably reinforced with fibre glass or the like. Such modules can also be formed of light-weight plywood, composition board or the like or of light-weight metals such as aluminum or aluminum-magnesium alloy sheets, extrusions or casting with rounded corners and rounded edges. Registering holes are provided in the planar boundary flanges or webs of the modules, through which bolts or other fastening means may be extended for securing the matching faces of successive modules to each other.

The several sizes of the modules of the toy on the one hand and of the playground equipment on the other hand are of different orders of magnitude. Thus, for instance, the largest size or "full-size" modules of the erector-toy embodiment may be of a size in which the longest edge of a module is of the general order of 6 to 10 inches, more or less, while in the erector playground equipment embodiment the longest edge of the largest-size or full-size module may be of the general order of magnitude of four or six feet (or greater). The longest edge of the half-size module is one-half the length of the corresponding longest edge of the full-size module, and the longest edge of the quarter-size module is one-quarter the length of the corresponding longest edge of the full-size module.

The modular erector toy and playground equipment of my invention comprises primary modules, secondary modules and tertiary modules which are tetrahedrons, pentahedrons, hexahedrons and septahedrons of uniform size and multiple-sizes having matching faces and complementary angles, and so related to each other that two of the primary tetrahedrons will form, optionally, either one of two different secondary tetrahedrons or a secondary hexahedron, and so that a pair of one of the two kinds of secondary tetrahedrons will form, optionally, either one of two pentahedrons or a septahedron.

The following is a brief summary description of the one primary module P and of the three secondary modules S-1, S-2 & S-3 and of the three tertiary modules T-1, T-2 & T-3.

The Primary tetrahedron module, designated hereinafter and in the drawings by the reference-letter P (illustrated in FIGS. 1 to 8), is comprised of

- one A wall, which is a right-angled isosceles triangle whose angles are 90°, 45° & 45°
- two B walls, each of which is a right-angled triangle whose angles are approximately 90°, 55° & 35°, and
- one C wall, which is an isosceles triangle whose angles are approximately 70°, 55° & 55°.

The three Secondary modules, designated hereinafter and in the drawings by the reference-letter S, are, respectively,

- the tetrahedron S-1,
- the tetrahedron S-2, and
- the hexahedron S-3.

The tetrahedron S-1 (illustrated in FIGS. 9 to 11) is formed of two P modules, with the A walls thereof in registration and full contact with each other, and has four C walls, in the following two pairs thereof:

- two of the C walls of module S-1 are the original C walls of the two P modules, and may hence be designated as oC walls, and are at a right angle to each other, the other two C walls of module S-1 are likewise at a right angle to each other, but each is in effect composed (and may actually be composed) of two co-planar B walls (of the opposite P modules), and may hence be regarded as derivative walls and designated as dC walls or as 2B walls, and each dC wall is at an (included) angle of 60° to an adjacent oC wall.

The tetrahedron module S-2 (illustrated in FIGS. 12 to 15) has one triangular D wall composed of the two co-planar A walls of the two P modules (hence may also be regarded as a 2A wall), the angles of such D wall are 90°, 45° & 45°, two original C walls or oC walls, and one E wall which is an isosceles triangle composed of two B walls with their shortest sides adjacent to each other, and the angles of such E wall are approximately 110°, 35° & 35°.

The hexahedron module S-3 (illustrated in FIGS. 16 & 17) is formed of two P modules with the C walls thereof in registration and full contact with each other, and has four B walls and two A walls, with the two A walls at a right-angle to each other along their hypotenuses, and with each B wall of one P module being at 120° to the juxtaposed B wall of the other P module The three Tertiary modules, designated hereinafter and in the drawings by the reference-letter T, are, respectively, the pentahedron T-1, the pentahedron T-2, and the septahedron T-3.

The pentahedron module T-1 is formed of two S-1 modules by any one of three different juxtapositions of such S-1 modules to each other; each of these three juxtapositions producing the same T-1 configuration.

One juxtaposition is that in which one dC wall of one S-1 module is in registration and in full contact with a dC wall of the other S-1 module (as ilustrated in FIGS. 18 to 21).

Another juxtaposition is that in which one oC wall of one module S-1 is in registration and in full contact with one of the oC walls of the other S-1 module.

The third juxtaposition is that in which an oC wall of one S-1 module is in registration and in full contact with a dC wall of the other S-1 module.

In each of these juxtapositions of the two S-1 modules, the resultant T-1 module (illustrated in FIGS. 18 to 21) has one rhombus-shaped F wall which is composed of either four B walls as in the first-mentioned juxtaposition (as illustrated in FIGS. 18 to 21) or of two original C walls (or oC walls) as in the second-mentioned juxtaposition, or of one oC wall and one dC wall as in the last-mentioned juxtaposition. The T-1 module also has four C walls (each at an included angle of 60° to the plane of the rhombus) which C walls may be either four original C walls or oC walls (as illustrated in FIGS. 18 to 21) or each of such C wall may be a derivative C wall (or dC), or two of them may be dC walls and two of them oC walls.

The pentahedron module T-2 (illustrated in FIGS. 22 to 24) is formed of two S-2 modules, with their B walls in registration and full contact with each other.

The pentahedron module T-2 has one square G wall composed of four A walls, and four original C walls (or oC walls) at 120° to each other and each at 45° to the square wall G.

The septahedron module T-3 (illustrated in FIGS. 25 to 29) is formed of two S-3 modules, with two A walls thereof in registration and full contact with each other, and has one square wall H composed of two A walls, and four B walls at right angles to each other and each at a right angle to the square G wall, and two derivative C walls (or dC walls) at a right angle to each other and at 120° to the adjacent B walls and at 45° to the G wall thereof.

BRIEF DESCRIPTION OF THE DRAWINGS

On the below-described perspective views, which are FIGS. 1, 2, 9, 10, 12, 13, 16, 17, 18, 22, 25 & 26, differentiating surface-patterns are applied to the inner and outer surfaces of the four walls A, B, B & C constituting the module, so as to provide for a more ready visual recognition of the various walls of the module. Thus, both the inner and outer surfaces of the A wall are covered with two sets of right-angularly disposed lines, and one of the two B walls has its inner and outer surfaces stipled with dots and the other B wall has its inner and outer surfaces covered with a single set of parallel lines, while the C wall has its inner and outer surfaces covered with interrupted lines or dash-lines.

The specific linear dimensions and specific angles inscribed on the below-described FIGS. 3 to 8 (inclusive) are approximate dimensions and angles, and in the case of the angles the minutes and seconds are ommitted and the angle-number is rounded out to the nearest full degree. It is also to be understood that the linear dimensions (which indicate the size of the module) are merely illustrative, and the size of the module may be increased or decreased—with the linear dimensions increasing or decreasing proportionately. However, the specific linear dimensions on FIGS. 3 to 8 represent a module of a size suitable for an erector-toy of the present invention, with the corresponding half-size or quarter-size modules having proportionately smaller linear dimensions. The largest-size primary module P, likewise illustrated in FIGS. 1–8, may be of the order of 8 to 12 times the size indicated by the linear dimensions in FIGS. 3–8.

Figures 1, 2, 3, 4, 5, 6, 7, 8:
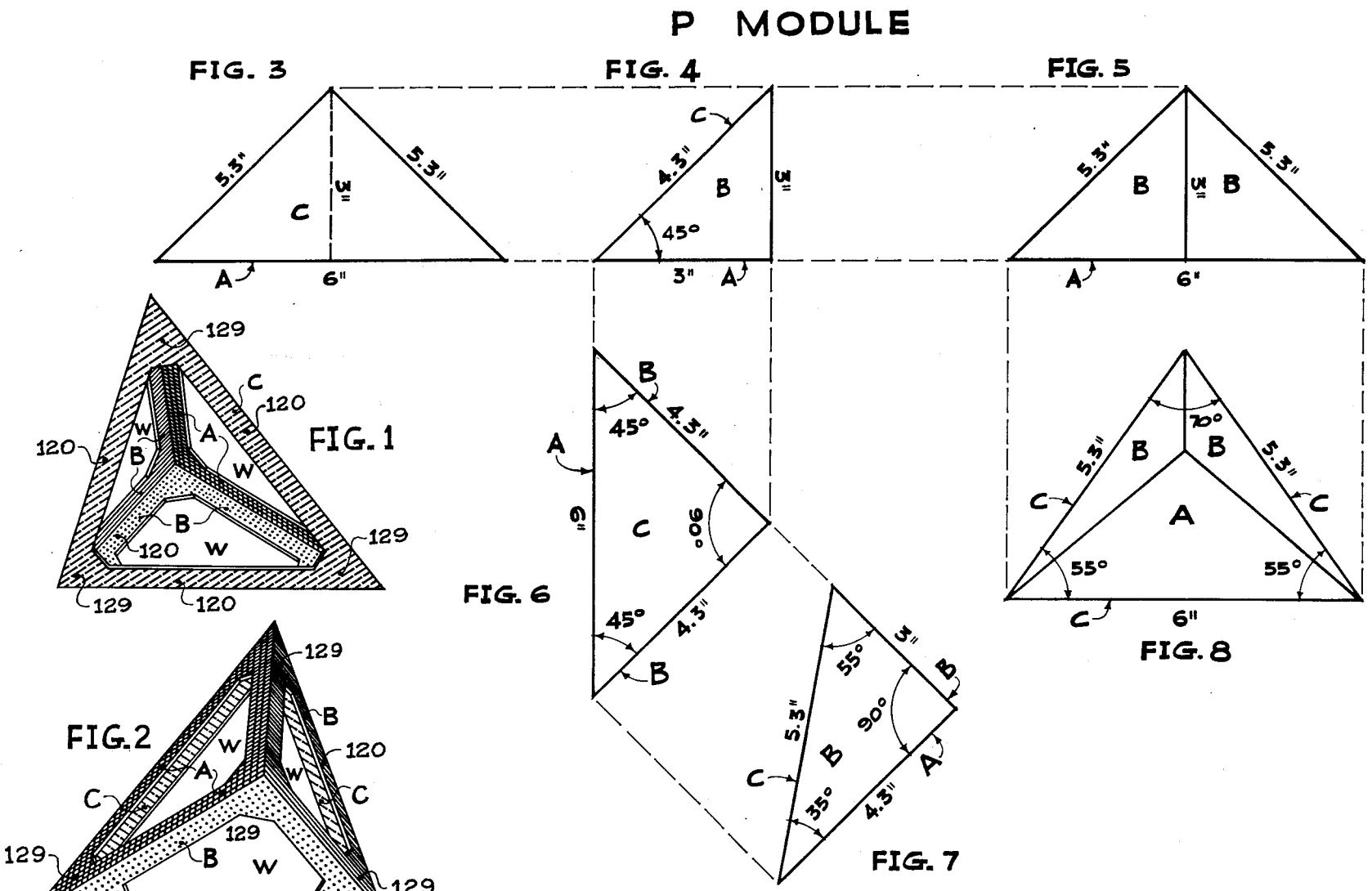
FIG. 1 represents a perspective view of the primary module P, with the C wall thereof facing the viewer and with the inner surface of the C wall being in the background and seen through the openings of one of the B walls and the opening in the A wall.
FIG. 2 represents another perspective view of the primary module P, with the A & B walls facing the viewer and with the inner surface of the C wall being in the background and seen through the openings of one of the B walls and the opening in the A wall.

FIG. 3 represents a view of primary module P, viewed parallel the wall A thereof (which wall A is represented by the bottom line in this view) and with the wall C of the module facing the viewer but receding from its bottom edge to its upper apex at a 45° vertical angle.

FIG. 4 represents a view of module P, viewed at a line-of-view which is at 90° to the line-of-view of FIG. 3, viewed parallel both to wall A and to wall C, and with one of the walls B facing the viewer but at a 45° horizontal angle to the line-of-view.

FIG. 5 represents a view of module P, viewed parallel to wall A thereof, and with each of the two B walls facing the viewer at a 45° horizontal angle.

FIG. 6 represents a view of module P, viewed parallel to each of the two B walls and with the C wall facing the viewer at a 45° angle to the line-of-view—with the three boundary lines also representing the A wall in plain view.

FIG. 7 represents a view of module P, viewed at a line-of-view 90° to the line-of-view of FIG. 6, with one of the two B walls facing the viewer at a right angle to the line-of-view and with its three boundary lines defining the B wall.

FIG. 8 represents a view of module B with the two B walls and the A wall facing the viewer, and with C wall underneath and at a right-angle to the line-of-view—the three outermost boundary lines defining the wall C.

Figures 9, 10, 11:
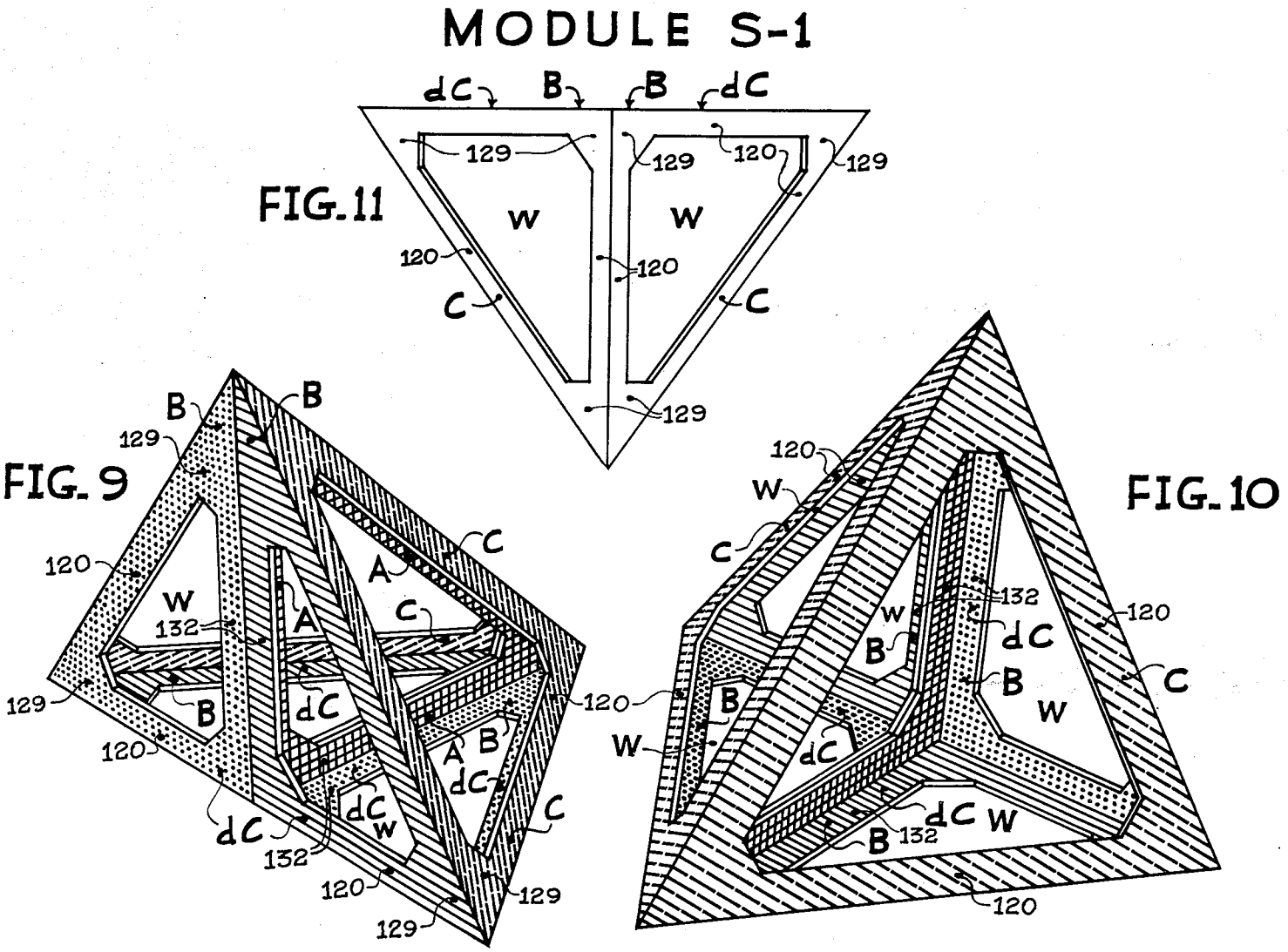

FIG. 9 represents a perspective view of module S-1 as formed of two P modules with their respective A walls in registration and contact with each other and with opposite B walls (of the two P modules) adjacent to each other in the same plane; each so adjacent pair of B walls (of the opposite P modules) forming a derivative C wall, marked dC in the drawings.

FIG. 10 represents another perspective view of module S-1 but viewed along a line-of-view which is approximately 180 horizontal degrees from the line-of-view of FIG. 9. In this view the two derivative C walls (dC) are at the bottom and in the rear, respectively, whereas the two original primary C walls face the viewer.

FIG. 11 represents a geometric-projection view of the module S-1 viewed along a line-of-view parallel to one of the dC walls and at a right angle to the other dC wall which is underneath the two original C walls facing the viewer.

Figure 12:
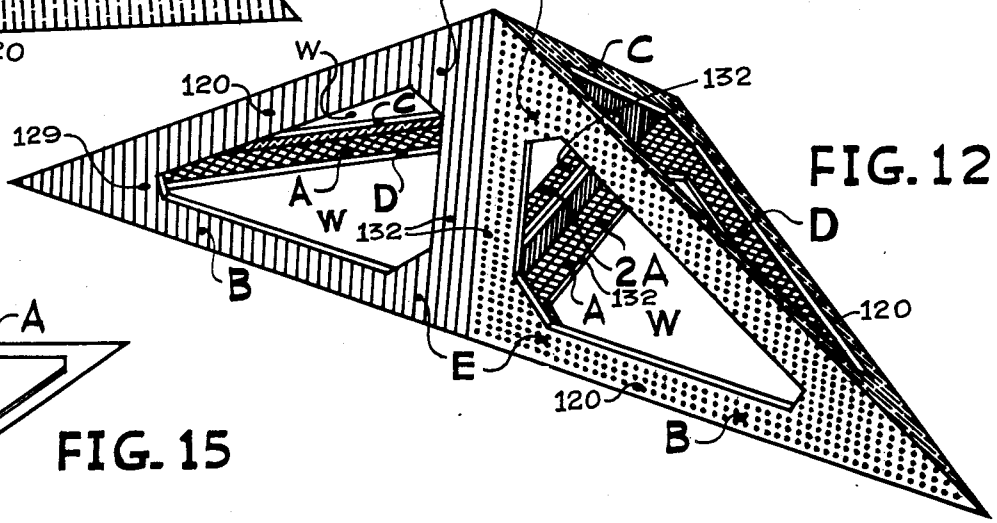

FIG. 12 represents a perspective view of module S-2 in which two opposite B walls of the two P modules are in registration and contact with each other and in which the other opposite B walls of said P modules are adjacent to each other in the same plane and face the viewer, and in which the 2A wall (formed of adjacent coplanar A walls) is shown at the bottom, and the two C walls are shown in the rear.

Figure 13:
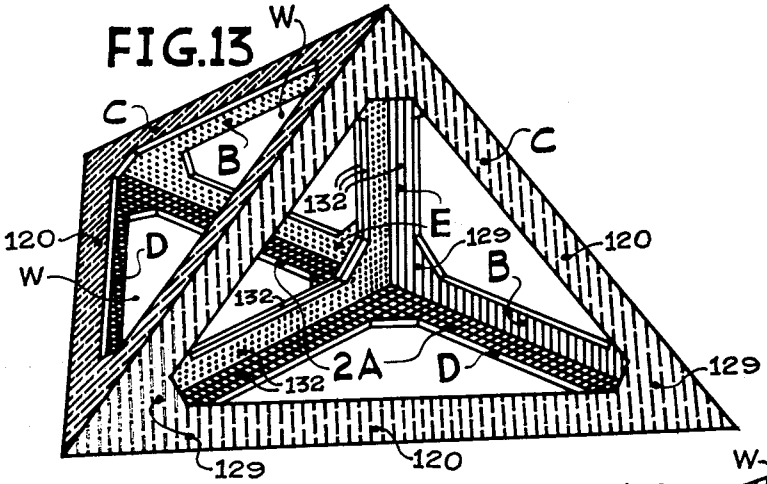

FIG. 13 is another perspective view of the S-2 module, but viewed along the line-of-view which is approximately 180 horizontal degrees from the line-of-view of FIG. 12, and shows the two coplanar B walls of the two P modules in the rear and shows the two original C walls facing the viewer.

Figure 14:
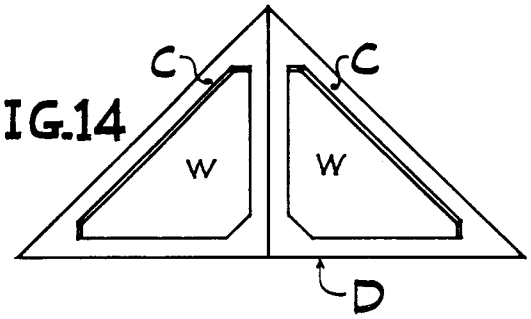

FIG. 14 represents a geometric-projection view of module S-2, viewed at a right angle to wall 2A at the bottom thereof and parallel to the wall D thereof and with the two C walls thereof facing the viewer (at an angle to the line-of-view).

Figure 15:
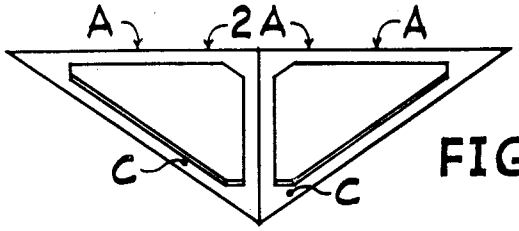

FIG. 15 represents a geometric-projection view of module S-2, viewed parallel to the 2A wall thereof and at a right-angle to the wall D at the bottom thereof, and with one of the two C walls thereof facing the viewer.

Figure 16:
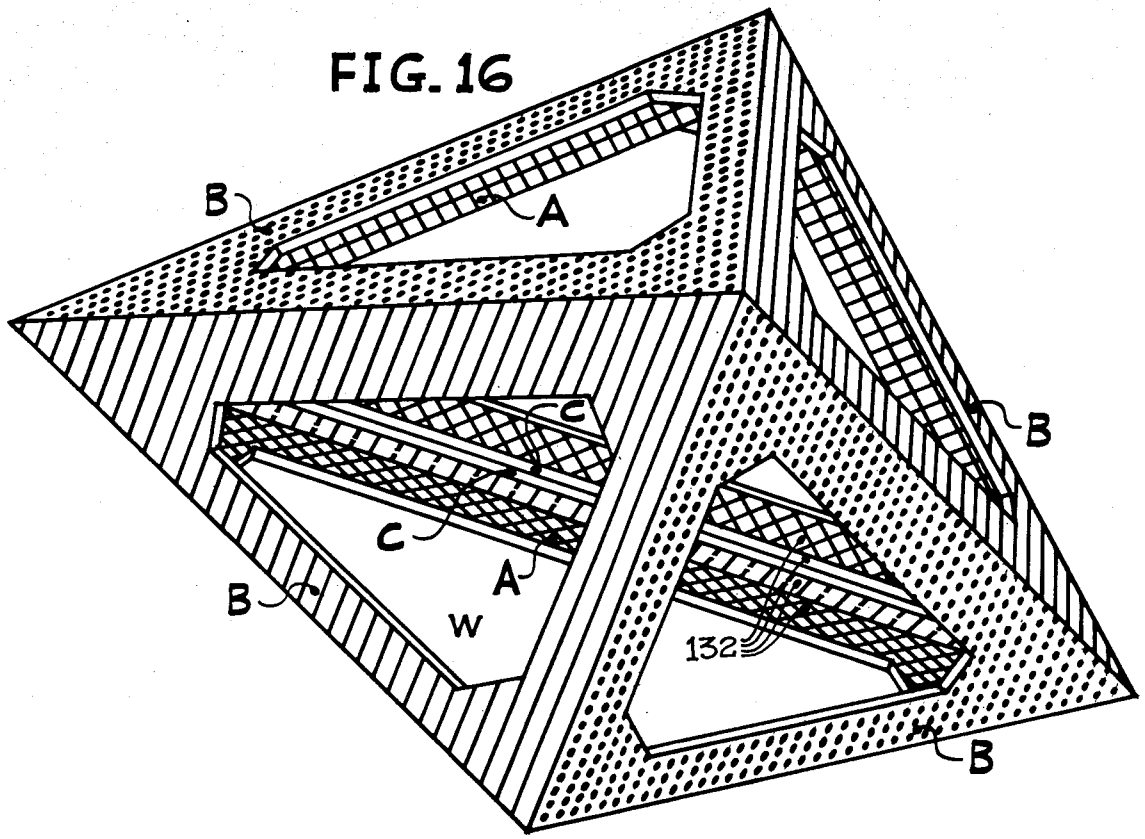
Figure 17:
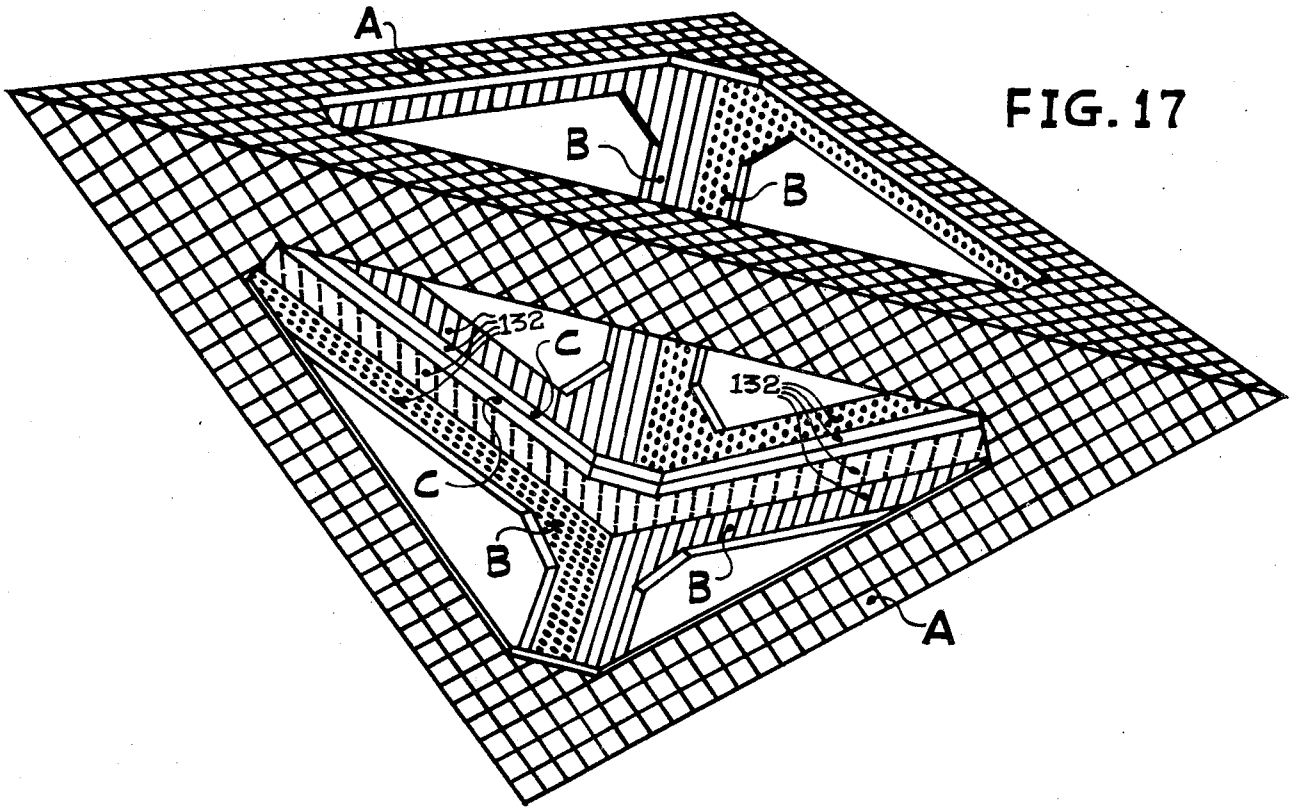

FIGS. 16 & 17 represent two perspective views of module S-3 in which the two C walls of the two P modules are in registration and contact with each other.

FIG. 16 shows module S-3 with four B walls thereof facing the viewer and with the two A walls thereof shown in the rear.

FIG. 17 shows module S-3 with the two A walls thereof facing the viewer and with the four B walls thereof in the rear.

Figure 18:
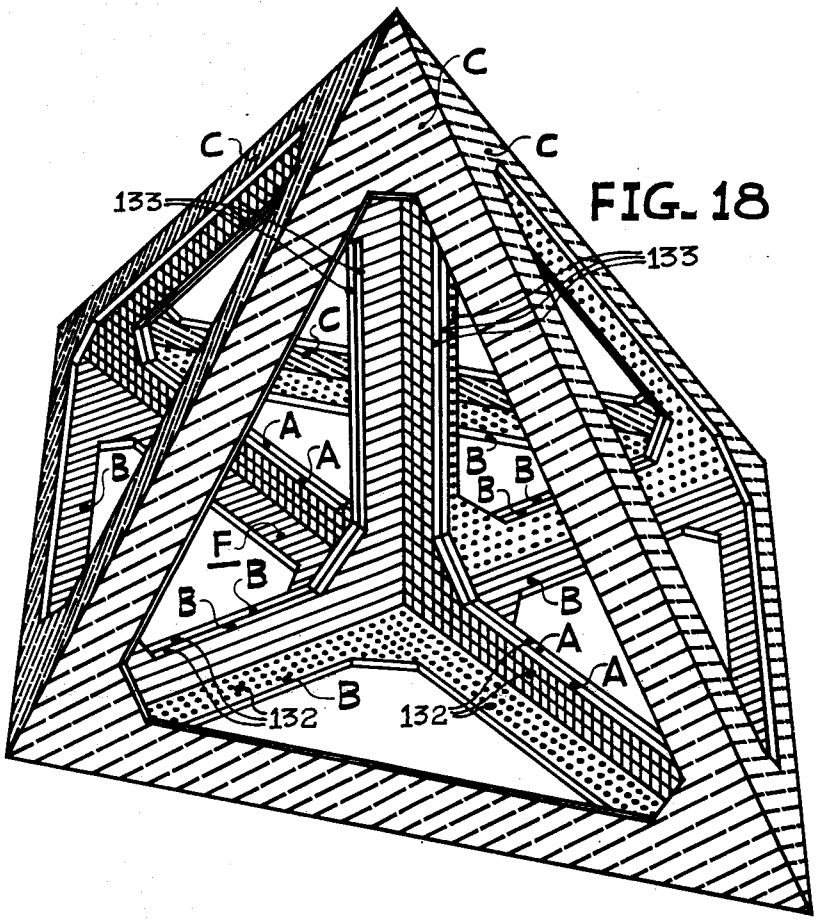

FIG. 18 represents a perspective view of module T-1, with its rhombus-shaped wall E (formed of four coplanar B walls) disposed at the bottom, and with its four C walls extending upwardly therefrom.

Figure 19:
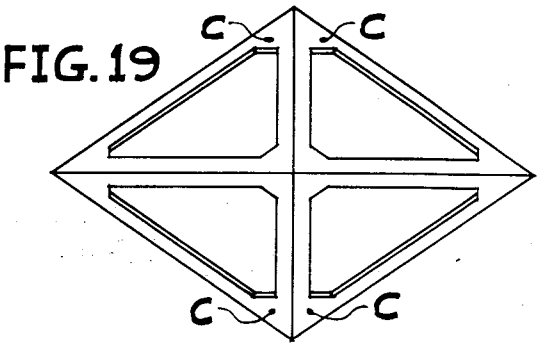

FIG. 19 represents a top plan view of module T-1 with a rhombus-shaped wall E at the bottom and with the four C walls facing upwardly at an angle to the line-of-view.

Figure 20:
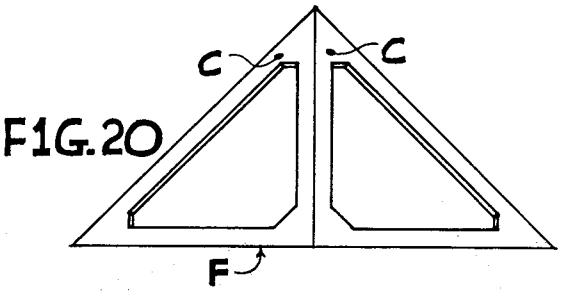

FIG. 20 represents a side elevational view of module T-1, viewed parallel to the wall E thereof, and at a right angle to the major diagonal of said wall E.

Figure 21:
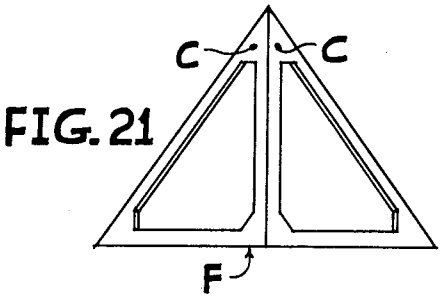

FIG. 21 represents a side elevational view of module T-1, but viewed at a horizontal angle 90° to the line-of-view of FIG. 20, or viewed on line 21—21 of FIG. 20.

Figure 22:
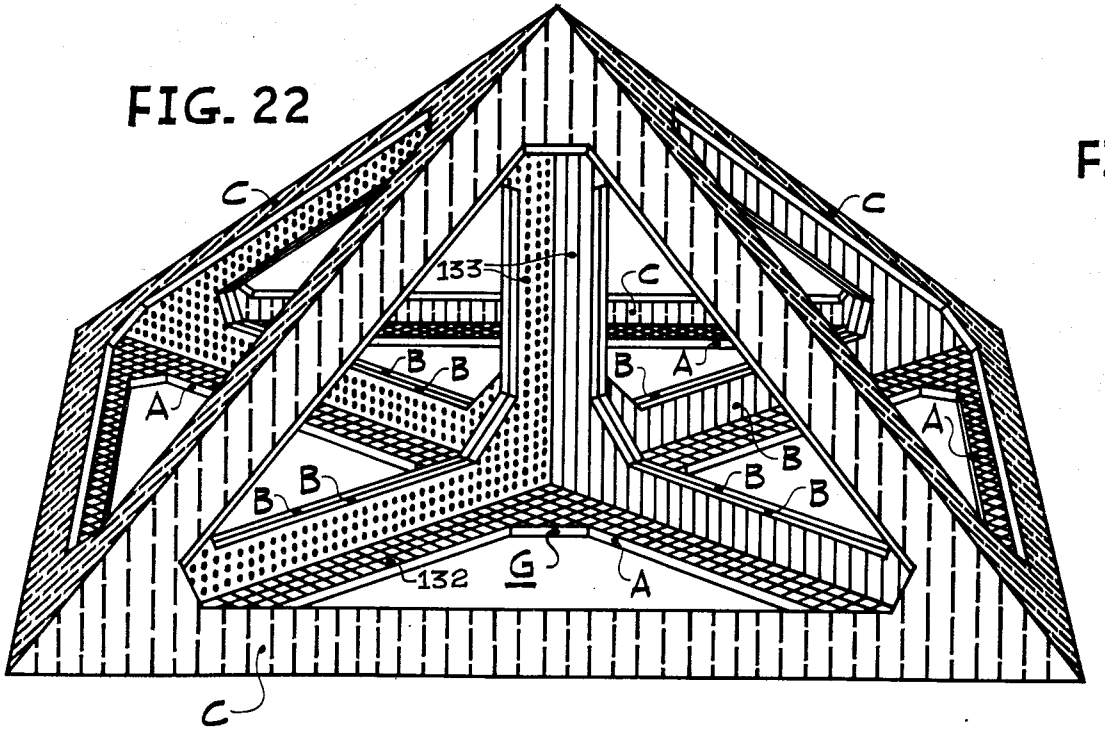

FIG. 22 represents a perspective view of module T-2, with the square S wall thereof at the bottom (formed of four A walls) and with the four C walls thereof rising upwardly from the bottom.

Figure 23:
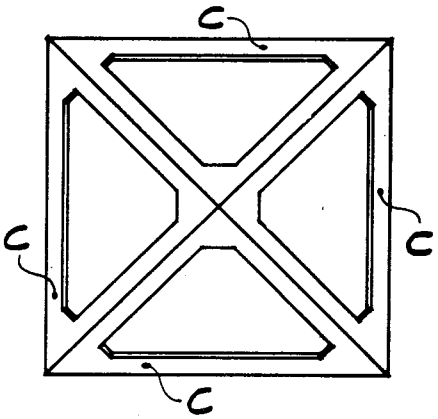

FIG. 23 represents a geometric view of module T-2, viewed at a right-angle to the four A walls forming the square S wall at the bottom, and with the four C walls facing the viewer.

Figure 24:
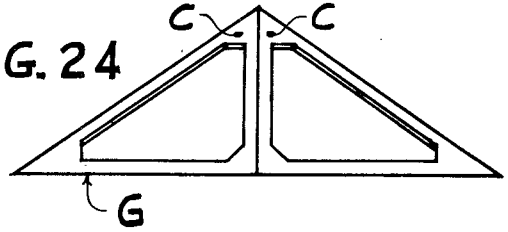

FIG. 24 represents another geometric-projection view of module T-2, viewed parallel to the S wall thereof and parallel to one of the juncture planes between B walls.

Figure 25:
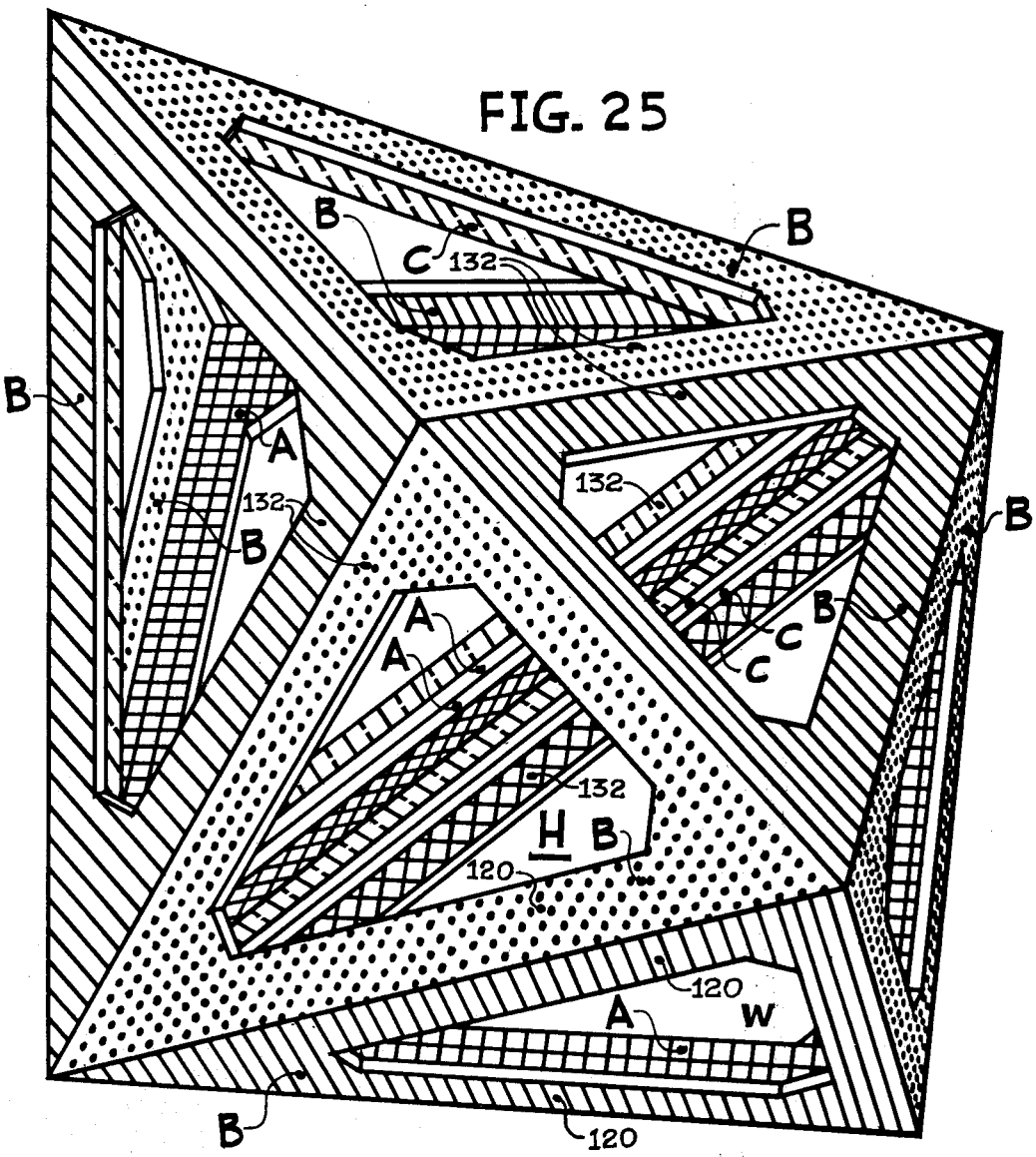

FIG. 25 represents a perspective view of module T-3, with the two A walls thereof shown in the rear (in what may be considered the bottom of the view) with the two B walls of a primary module facing the viewer in the lower right-hand portion of the Figure and four B walls of two of the primary modules also facing the viewer but extending upwardly and rearwardly, to the left.

Figure 26:
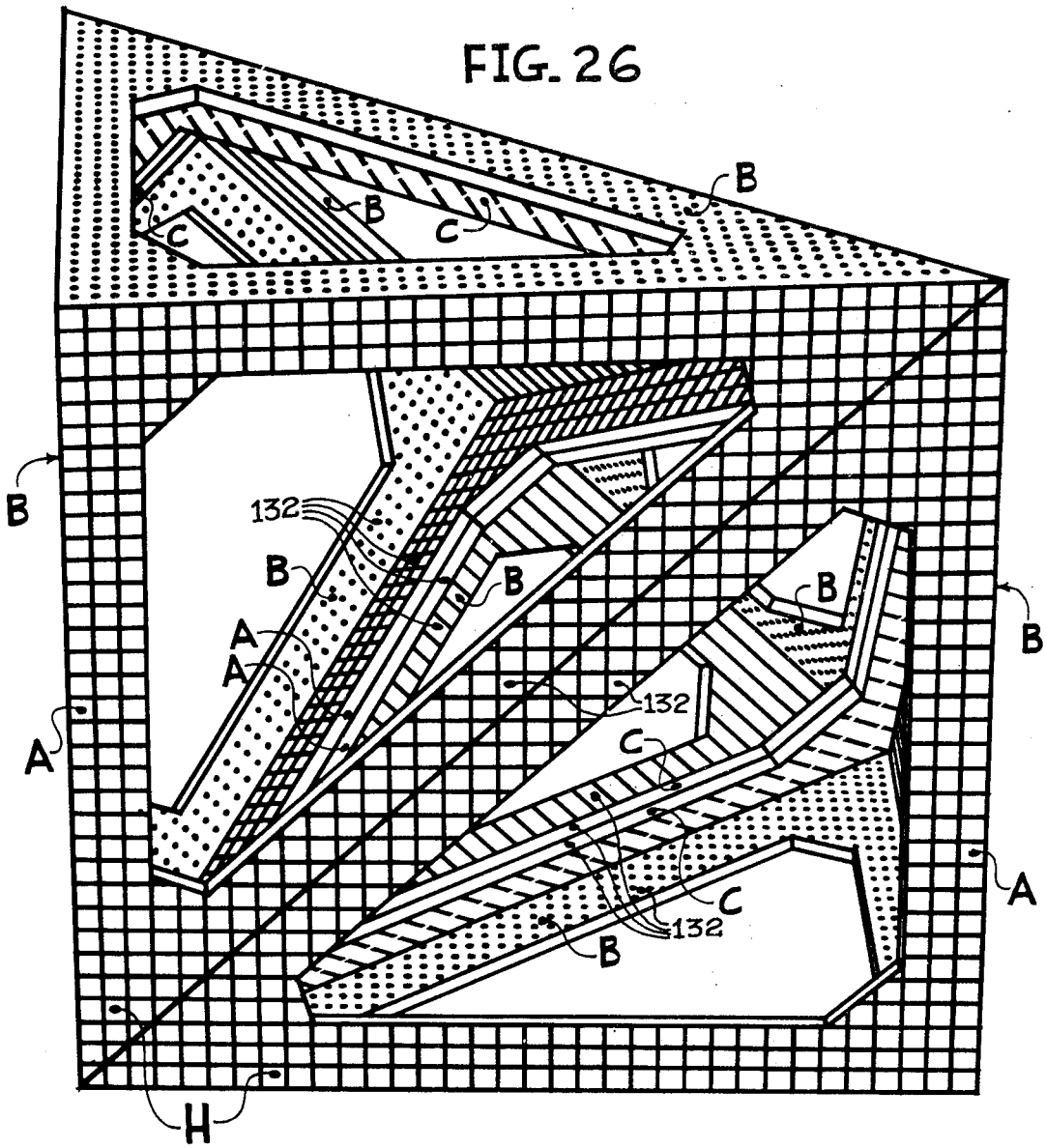

FIG. 26 represents another perspective view of module T-3 but with the two coplanar A walls facing the viewer at an angle slightly less than 90° to the line-of-view and with one of the B walls of an adjacent primary module shown at the top, at an acute angle to the line-of-view.

Figure 27:
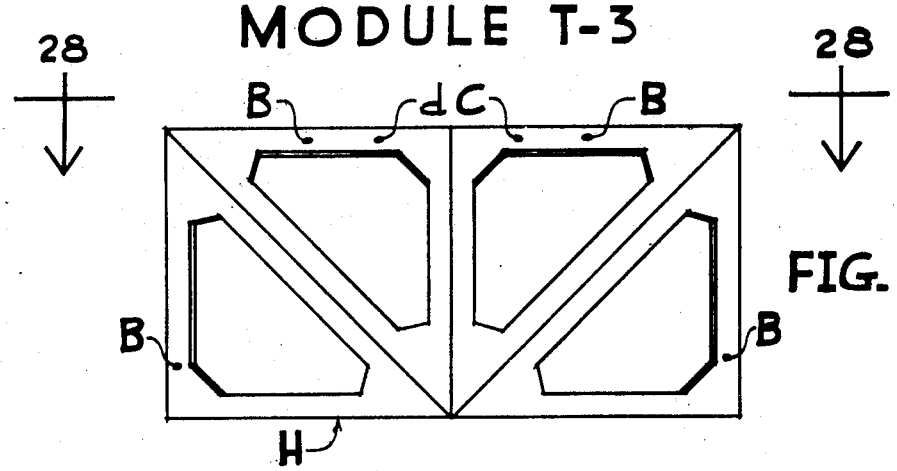

FIG. 27 represents a geometric-projection view of module T-3, with the square G wall thereof at the bottom (at a right angle to the line-of-view) and with the two derivative C walls (dC) facing the viewer, at opposite 45° angles to the line-of-view.

Figure 28:
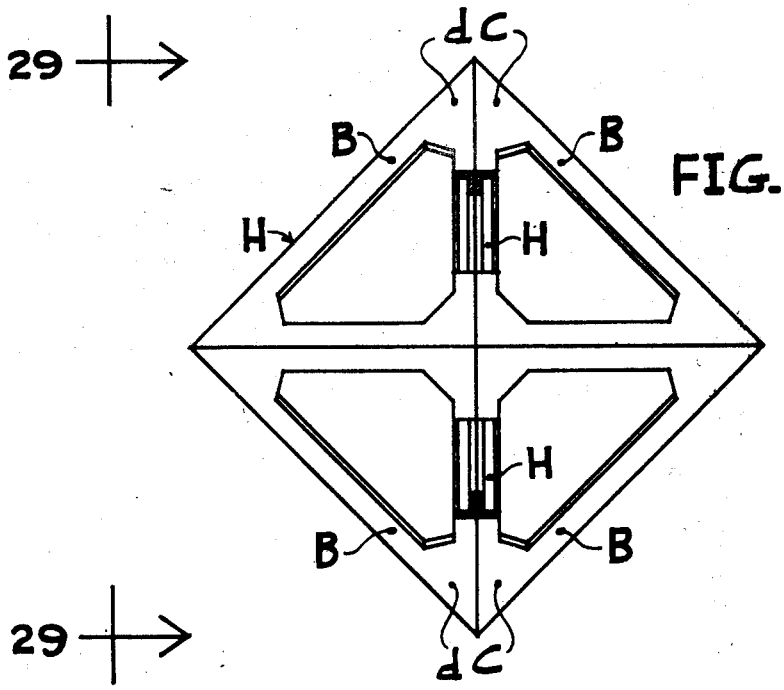

FIG. 28 represents an top plan view on line 28—28 of FIG. 27.

Figure 29:
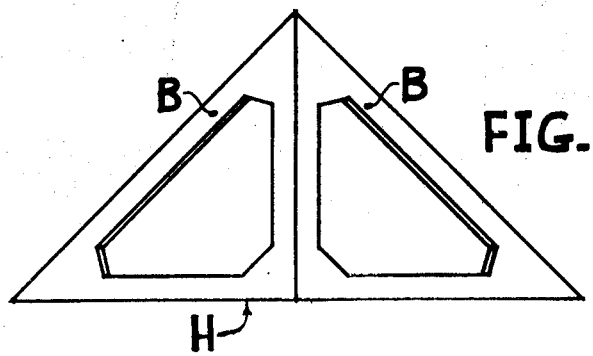

FIG. 29 represents an elevational view on line 29—29 of FIG. 8.

FIG. 30 represents a view of fenestrated hollow educational toy embodiment of the primary module P, with the A wall and the two B walls thereof facing the viewer, at an angle to the line-of-view which is at a right angle to the C wall of the module which is underneath and only the boundary-lines C of which are shown in this view.

FIG. 31 is another view of the module P shown in FIG. 30, but with the wall A thereof facing the viewer at a right angle to the line-of-view.

FIG. 32 represents another view of the embodiment shown in FIG. 30, but with one of the B walls facing the viewer at a right angle to the line-of-view.

FIG. 33 represents a view of the primary module P, similar to that shown in FIG. 30, but of the solid or unfenestrated embodiment of the educational toy.

FIG. 34 represents a half-size embodiment of the hollow fenestrated primary module P shown in FIG. 30, but with the C wall thereof facing the viewer at a right-angle to the line-of-view.

FIG. 35 represents a half-size embodiment of the solid or unfenestrated primary module P shown in FIG. 33, viewed the same as in FIGS. 30 & 33.

FIG. 36 represents another view of the half-size solid or unfenestrated primary module P, with the wall C thereof facing the viewer at a right-angle to the line-of-view (the same as in FIG. 34).

Figure 37:
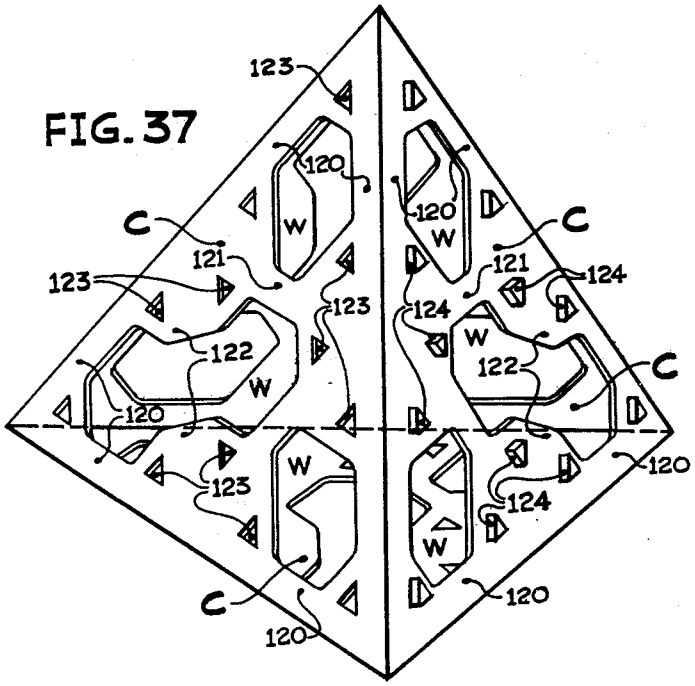

FIG. 37 represents a perspective view of a hollow and fenestrated educational toy embodiment of the tetrahedron module S-1 with two of the C walls thereof facing the viewer and two of the C walls thereof in the background.

Figure 38:
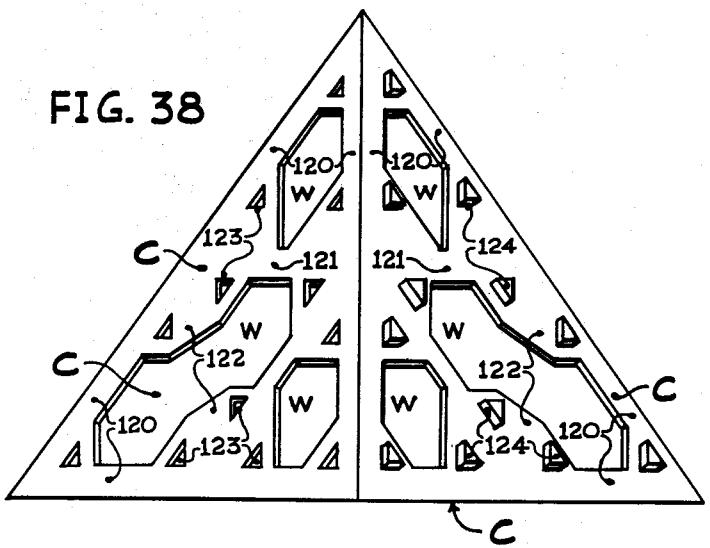

FIG. 38 represents a geometric elevational view of the embodiment shown in FIG. 37, with two C walls thereof facing the viewer and with the line-of-view parallel to one of the other C walls (which is at the bottom of this view) and at a right-angle to the other C wall which is in the rear.

Figure 39:
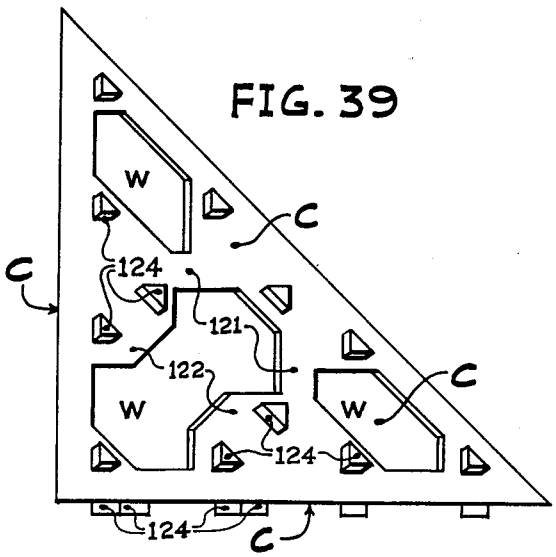

FIG. 39 represents another geometric elevational view of the S-1 module, with the module turned 90 horizontal degrees from the view shown in FIG. 38, namely, to a line-of-view parallel to two of the C walls represented by the bottom edge-line and the left edge-line of view, and with one of the intervening C walls facing the viewer at 45° to the line-of-view.

Figure 40:
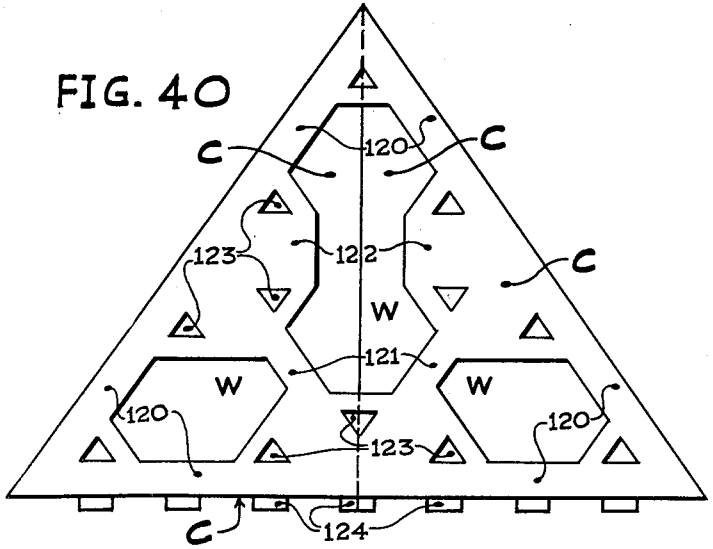

FIG. 40 represents a geometric view of the embodiment of the S-1 module shown in FIGS. 37, 38 & 39, viewed 90° from the view shown in FIG. 39 and 180° from the view shown in FIG. 38, and showing one of the C walls at a right-angle to the line-of-view.

Figure 41:
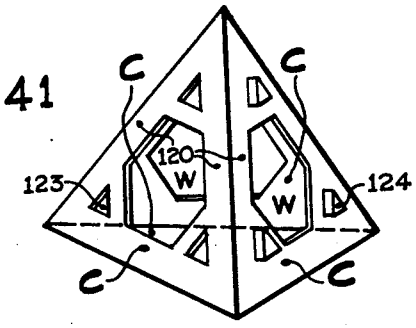

FIG. 41 is a perspective view, similar to that shown in FIG. 37, of a half-size secondary module S-1.

Figure 42:
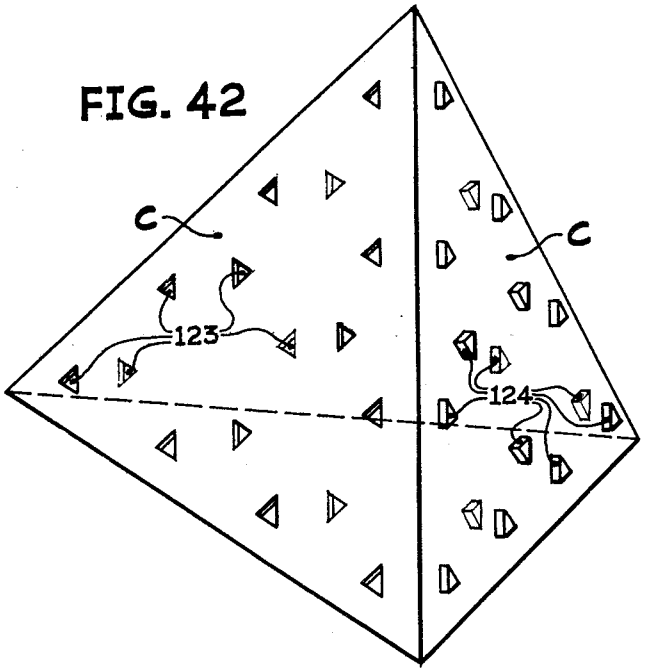

FIG. 42 is a perspective view of secondary module S-1 but illustrating the solid or unfenestrated educational toy embodiment thereof.

Figure 43:
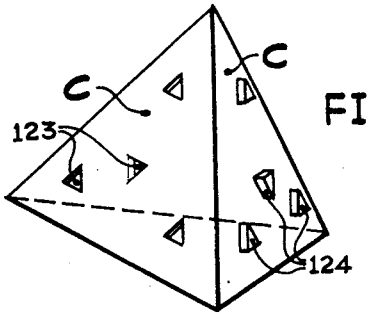

FIG. 43 represents a perspective view similar to that shown in FIG. 42, but of a half-size embodiment of the module shown in FIG. 42.

Figure 44:
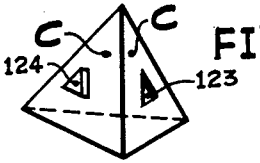

FIG. 44 represents a perspective view, similar to that shown in FIGS. 42 & 43 of the quarter-size of the embodiment shown in FIG. 42 and of a half-size of the embodiment shown in FIG. 43.

Figure 45:
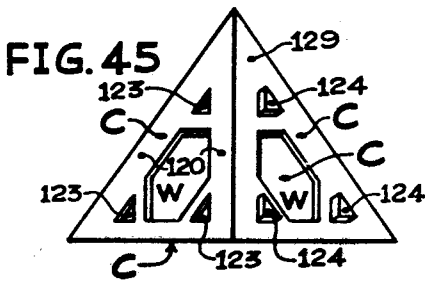

FIG. 45 represents a geometric elevational view of the half-size embodiment shown in FIG. 41, viewed along a line-of-view parallel to the bottom C wall represented by the bottom line thereof and at a right-angle to the C wall which is in the rear, with the two facing C walls each at 45° to the line-of-view.

Figure 46:
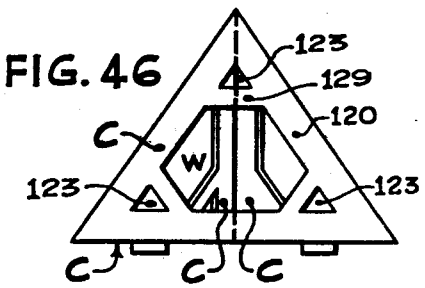

FIG. 46 is another geometric elevational view of the half-size embodiment of the secondary module S-1 shown in FIG. 45, but with the module turned at 180 horizontal degrees with respect to its position in FIG. 45, and with one of the C walls facing the viewer at a right angle to the line-of-view and with the one C wall at the bottom and two C walls in the rear, each of the latter at an angle to the line-of-view.

Figure 47:
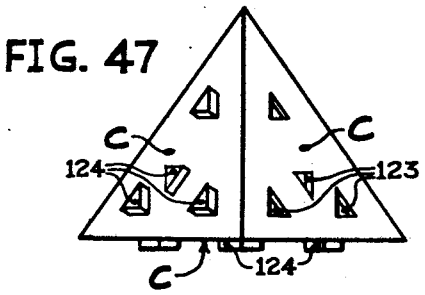

FIG. 47 represents a geometric elevational view similar to that shown in FIG. 45 but illustrating the solid or unfenestrated half-size embodiment of the secondary module S-2.

Figure 48:
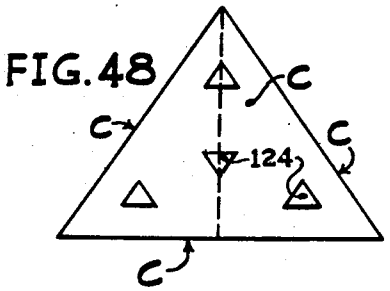

FIG. 48 represents a view similar to that shown in FIG. 46, illustrating the solid or unfenestrated embodiment of the secondary module S-2.

Figure 49:
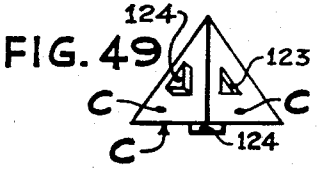

FIG. 49 represents a geometric elevational view of the quarter-size module illustrated in FIG. 44, but viewed in elevation the same as in FIG. 47.

Figure 50:
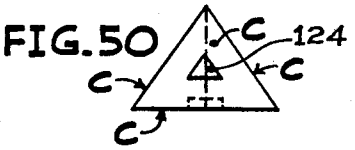

FIG. 50 represents a geometric view of a quarter-size secondary module S-1 shown in FIGS. 44 & 49, but viewed the same as in FIG. 48.

Figure 51:
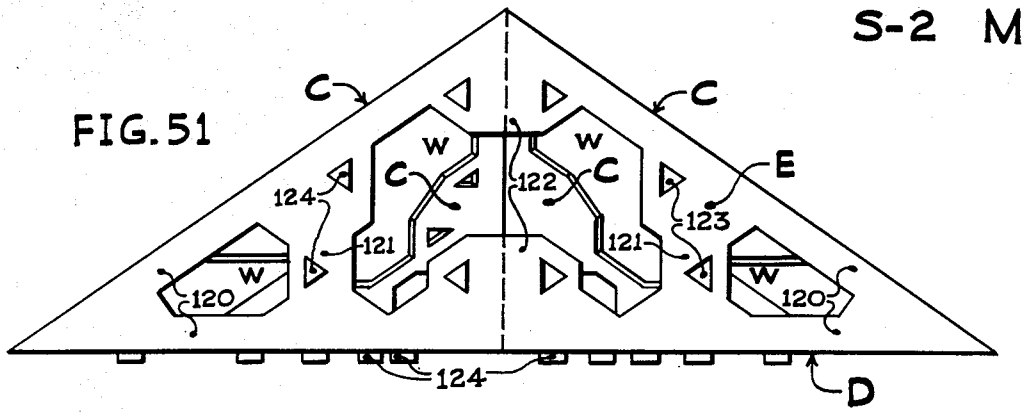

FIG. 51 represents an elevational view of the fenestrated toy embodiment of the S-2 module, viewed at a right angle to the wall E thereof and parallel to the D wall thereof which is at the bottom in this view, and with the two C walls thereof in the background.

Figure 52:
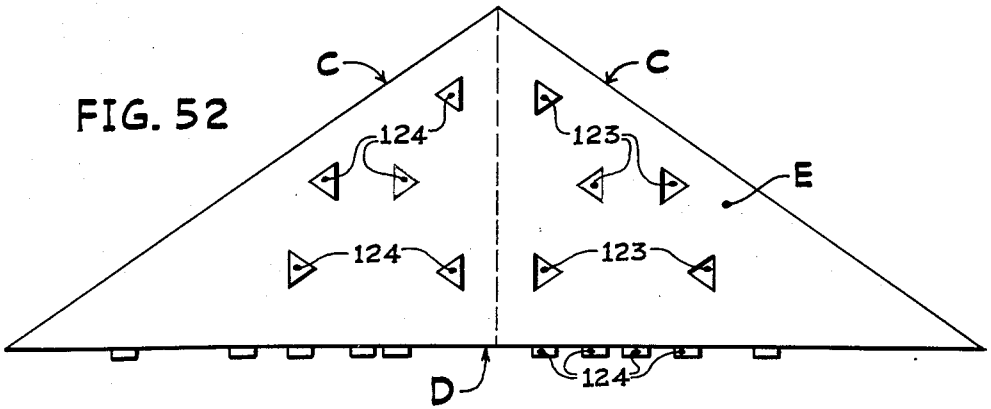

FIG. 52 represents an elevational view (similar to that shown in FIG. 51) of the solid or unfenestrated toy embodiment of the S-2 module.

Figure 53:
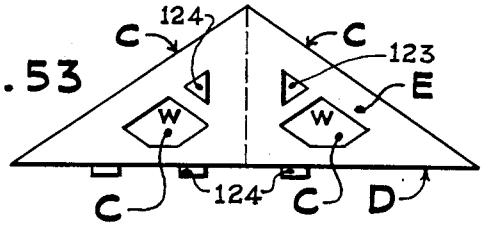

FIG. 53 represents an elevational view, similar to that shown in FIG. 51, a half-size fenestrated S-2 module.

Figure 54:
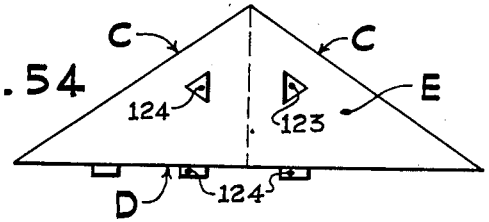

FIG. 54 represents an elevational view, similar to that shown in FIG. 52, of the solid or unfenestrated half-size module S-2.

Figure 55:
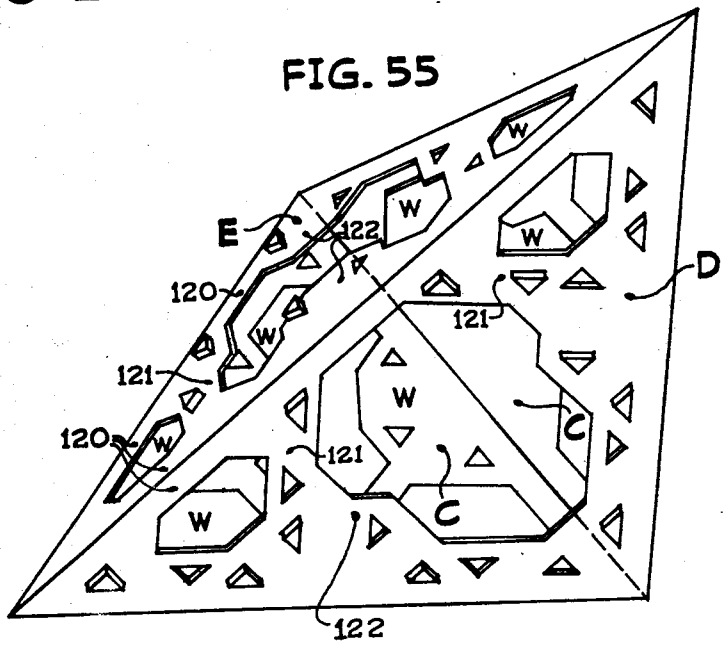

FIG. 55 represents a perspective view of the fenestrated toy embodiment of the S-2 module shown in FIG. 51, with a D wall and the E wall thereof facing the viewer, and with the two C walls thereof in the rear.

Figure 56:
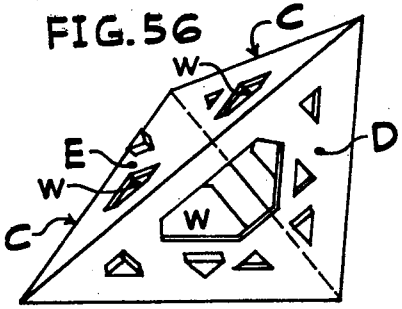

FIG. 56 represents a perspective view, similar to that shown in FIG. 55, illustrating a half-size fenestrated toy embodiment of the S-2 module.

Figure 57:
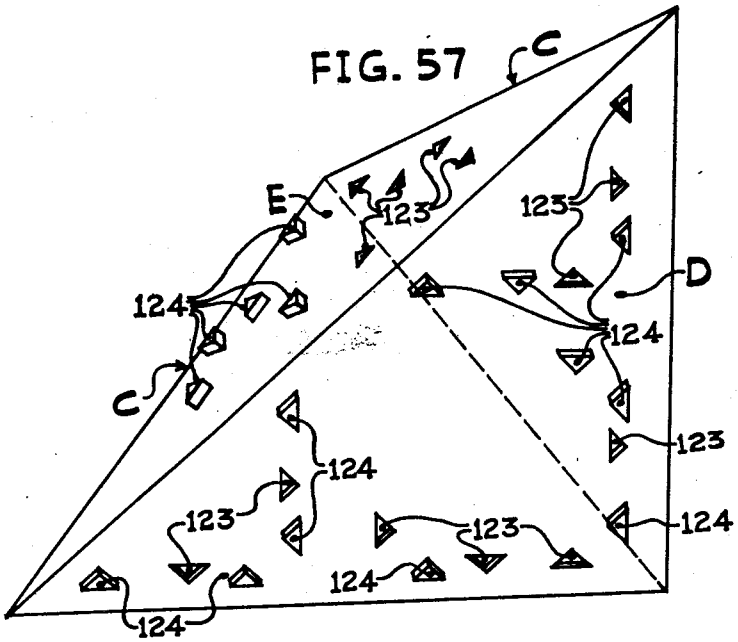

FIG. 57 represents a perspective view, similar to that shown in FIG. 55, of the unfenestrated toy embodiment of the S-2 module.

Figure 58:
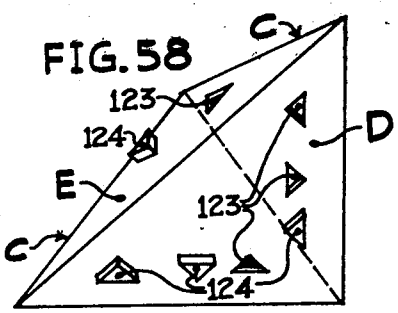

FIG. 58 represents a perspective view, similar to that shown in FIG. 57, of the unfenestrated half-size toy embodiment of the S-2 module.

Figure 59:
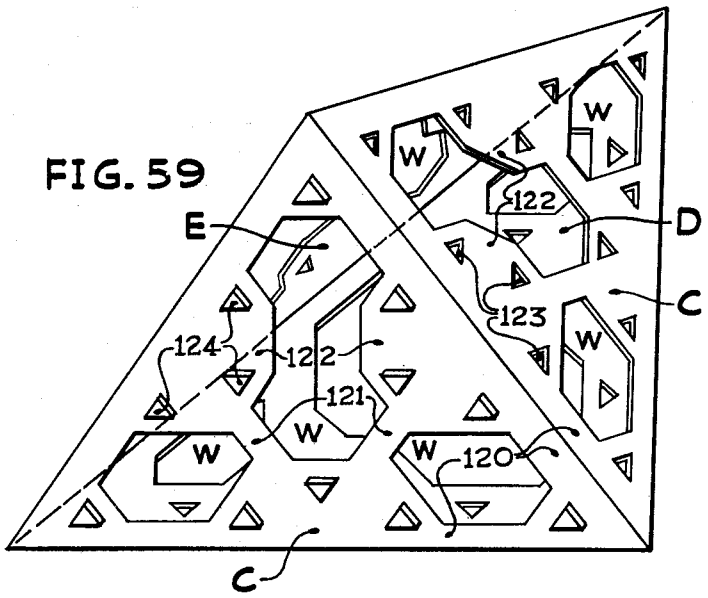

FIG. 59 represents a perspective view of the fenestrated toy embodiment of the S-2 module shown in FIG. 55, but with the two C walls thereof facing the viewer and with the D wall and the E wall thereof in the rear.

Figure 60:
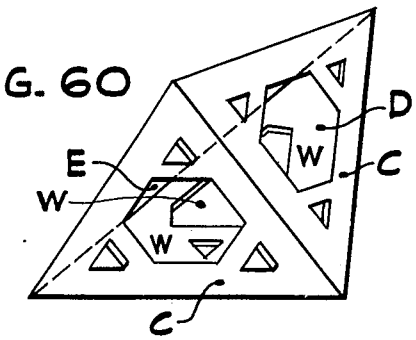

FIG. 60 represents a perspective view, similar to that shown in FIG. 59, of the half-size fenestrated toy embodiment of the S-2 module.

Figure 61:
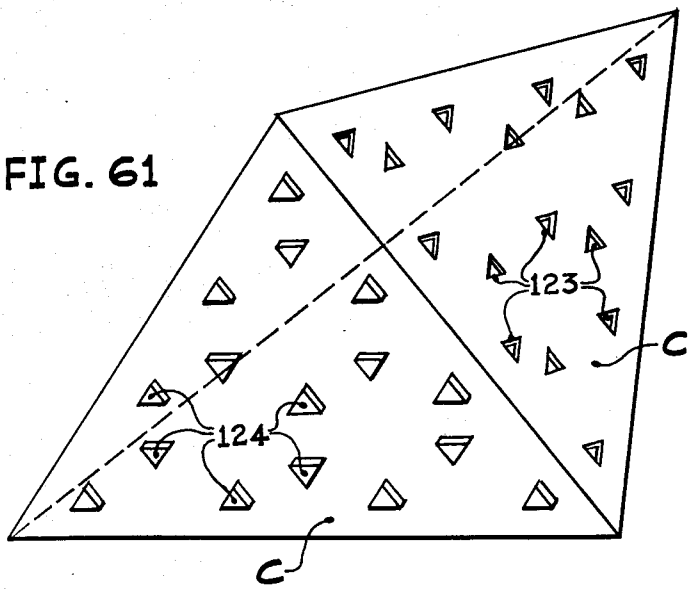

FIG. 61 represents a perspective view, like that shown in FIG. 59, of the unfenestrated toy embodiment of the S-2 module.

Figure 62:
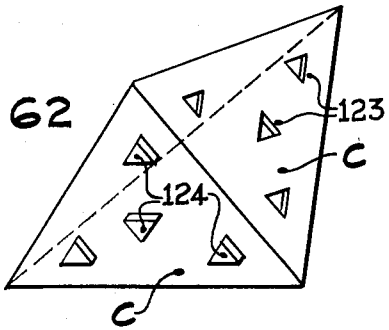

FIG. 62 represents a perspective view, like that shown in FIG. 61, of the half-size unfenestrated toy embodiment of the S-2 module.

Figure 63:
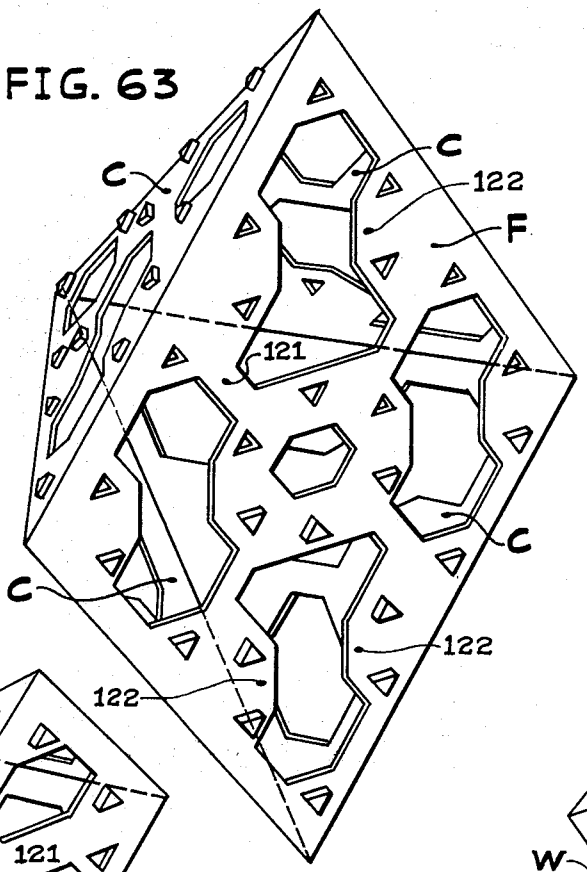

FIG. 63 represents a perspective view of the fenestrated toy embodiment of the T-1 module with the rhombus-shaped F wall thereof and one of the C walls thereof facing the viewer, and with the other three C walls thereof in the rear.

Figure 64:
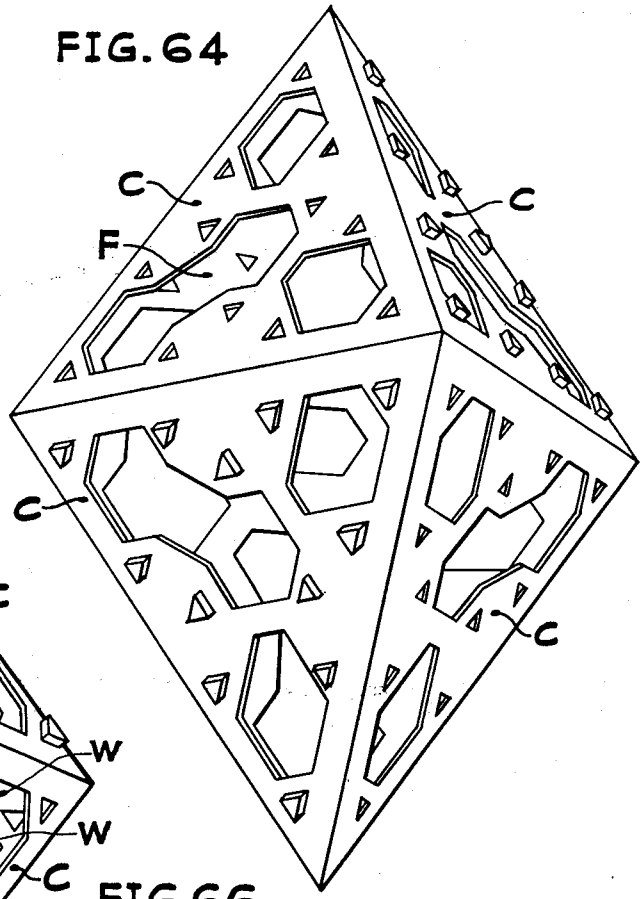

FIG. 64 represents another perspective view of the fenestrated toy embodiment of the T-1 module, but with the four C walls facing the viewer and with the rhombus-shaped F walls thereof in the rear.

Figure 65:
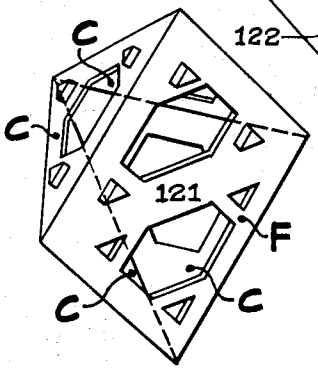

FIG. 65 is a perspective view, like that shown in FIG. 63, of a half-size fenestrated toy embodiment of the T-1 module.

Figure 66:
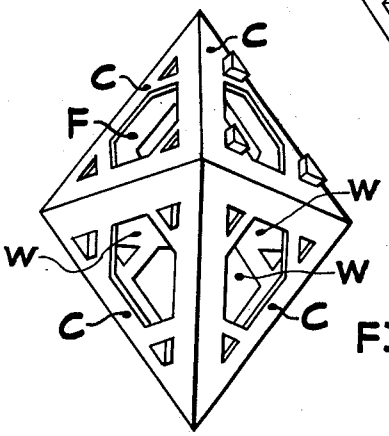

FIG. 66 represents a perspective view, like that of FIG. 64, of the half-size fenestrated toy embodiment of the T-1 module.

Figure 67:
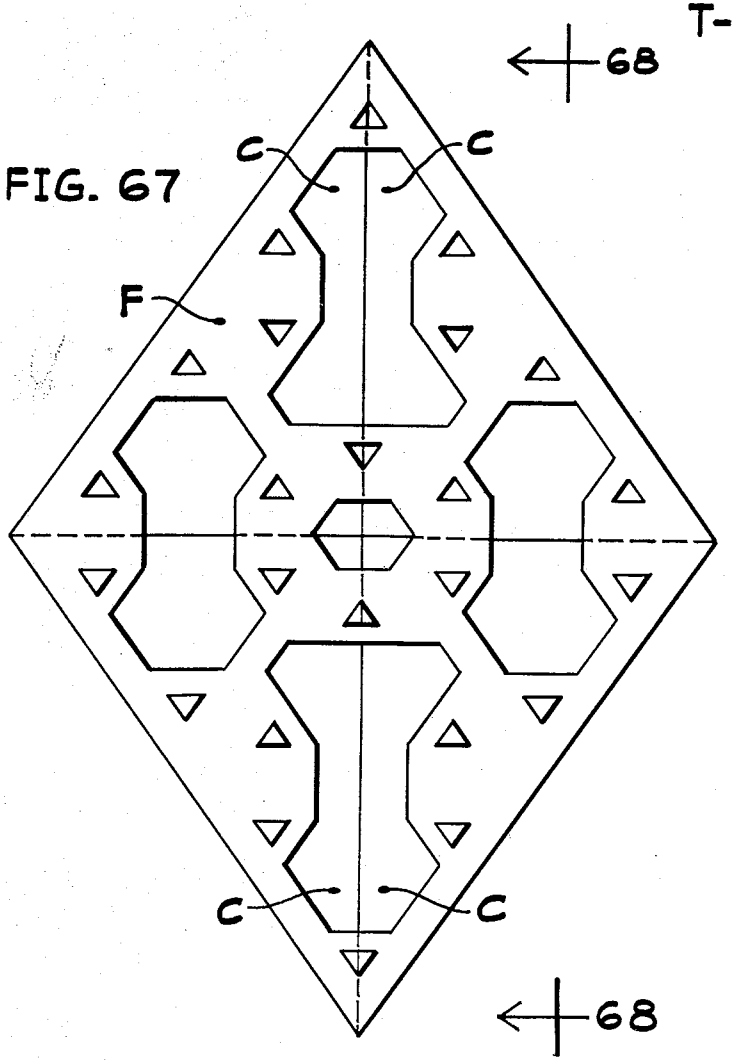

FIG. 67 represents a view of the fenestrated T-1 module shown in FIGS. 63 & 64, but viewed with the F wall thereof facing the viewer at a right angle to the line-of-view, and with the four C walls thereof in the rear or underneath, and with the fenestrations (and projections and recessions) of the C walls omitted from this view.

Figure 68:
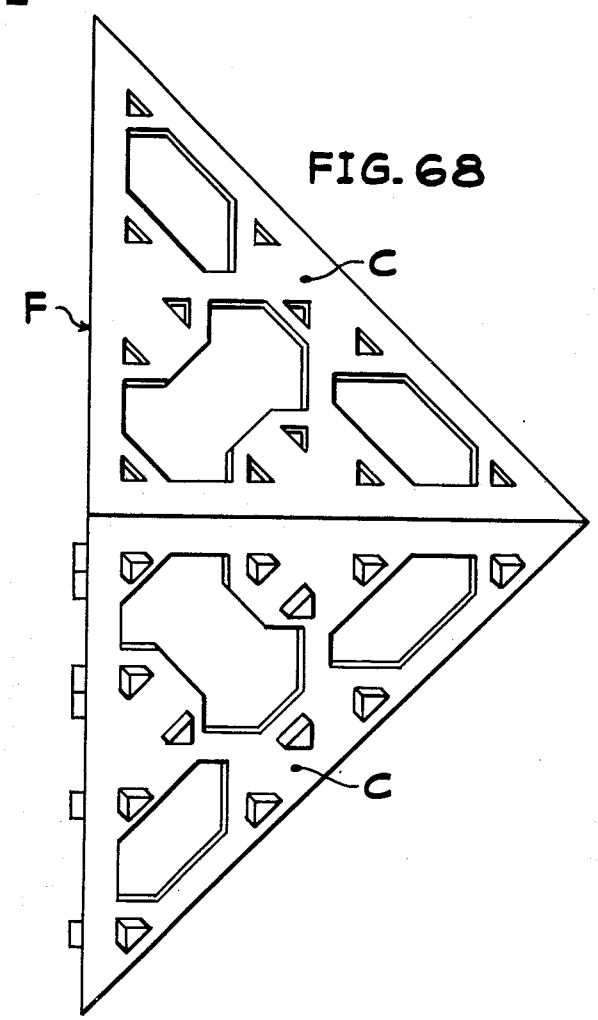

FIG. 68 represents a view of the fenestrated toy embodiment of the T-1 module, viewed on line 68—68 of FIG. 67.

Figure 69:
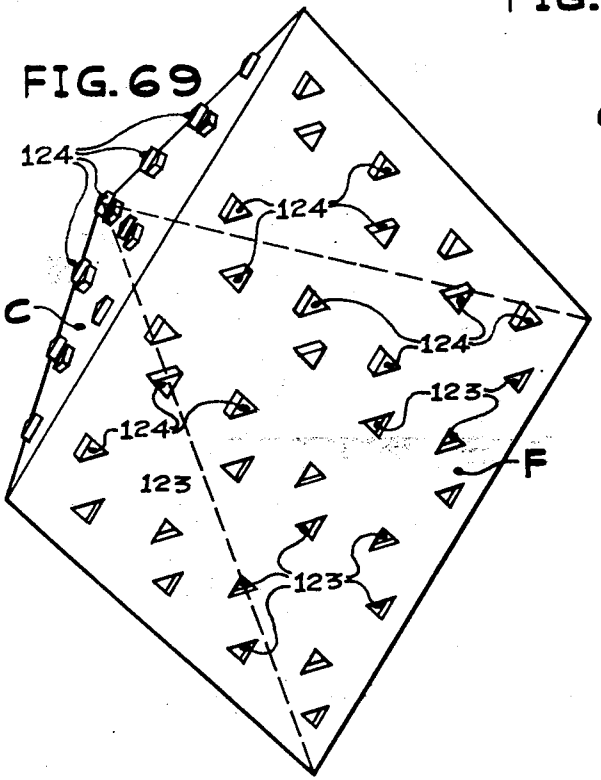

FIG. 69 represents a perspective view, like that shown in FIG. 63, of the unfenestrated toy embodiment of the T-1 module.

Figure 70:
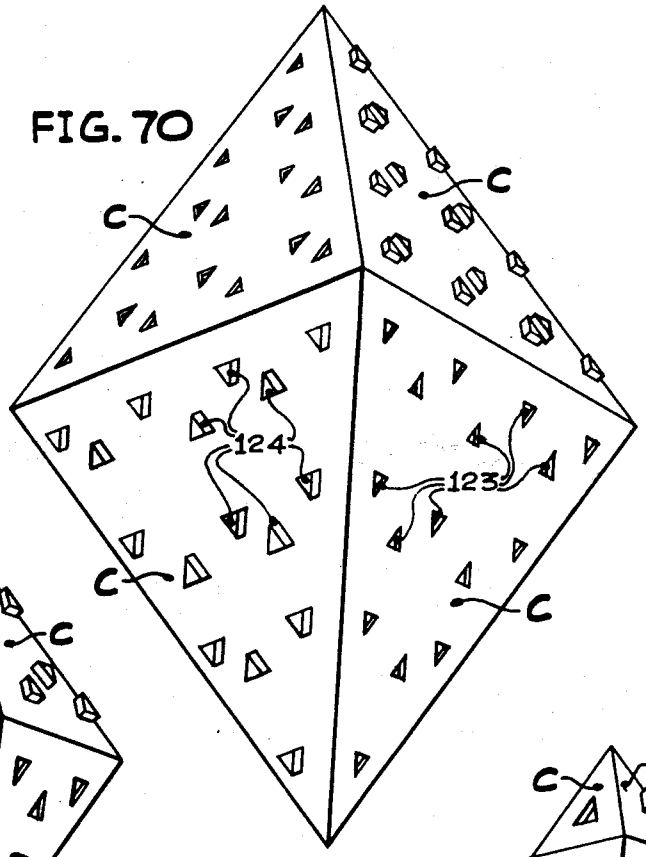

FIG. 70 represents a perspective view, like that of FIG. 64, of the unfenestrated toy embodiment of the T-1 module.

Figure 71:
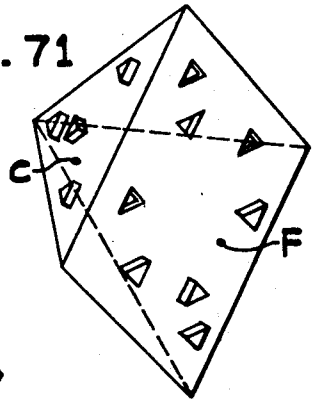

FIG. 71 represents a perspective view, like that of FIG. 69, illustrating the half-size unfenestrated toy embodiment of the T-1 module.

Figure 72:
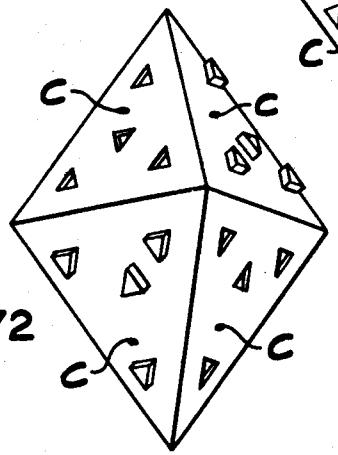

FIG. 72 represents a perspective view, like that of FIG. 70, of the half-size unfenestrated toy embodiment of the T-1 module.

Figure 73:
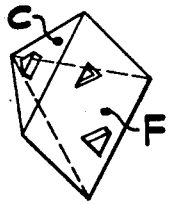

FIG. 73 represents a perspective view, like that of FIGS. 69 and 71, of the quarter-size unfenestrated toy embodiment of the T-1 module.

Figure 74:
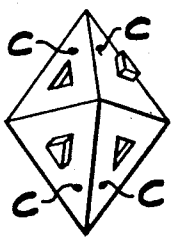

FIG. 74 represents a perspective view, like that of FIGS. 70 and 72, of the quarter-size unfenestrated toy embodiment of the T-1 module.

Figure 75:
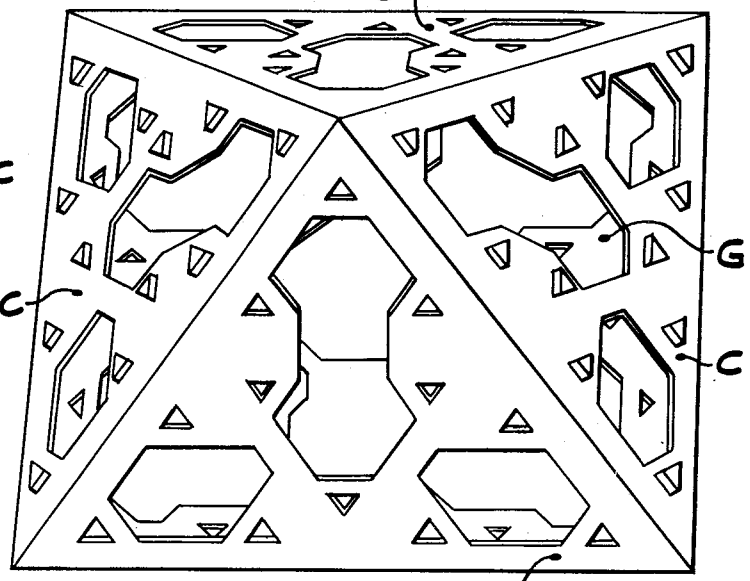

FIG. 75 represents a perspective view of the fenestrated toy embodiment of the T-2 module, with the four C walls thereof facing the viewer, and with the square G wall thereof therebeneath.

Figure 76:
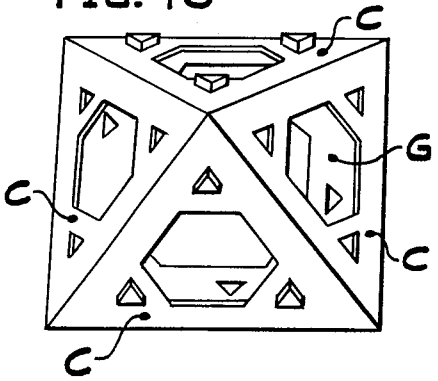

FIG. 76 represents a similar perspective view of the half-size fenestrated toy embodiment of the T-2 module.

Figure 77:
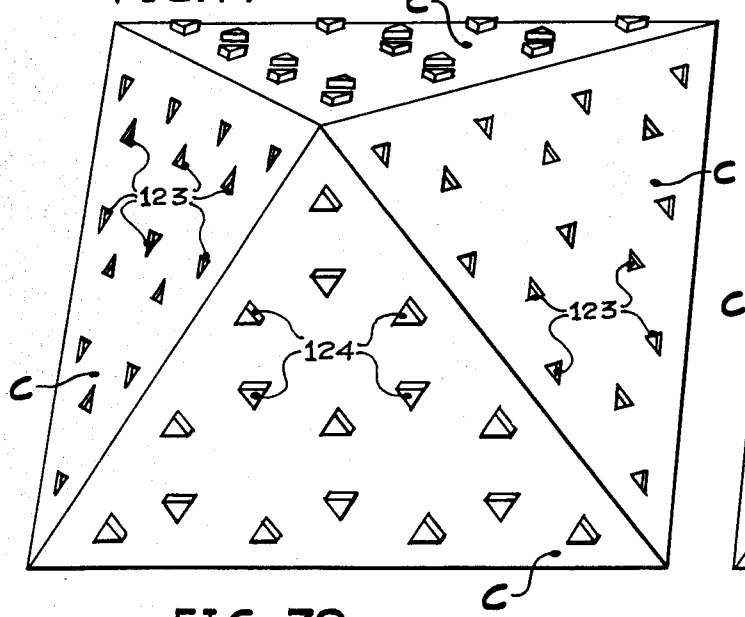

FIG. 77 represents a perspective view, like that shown in FIG. 75, of the unfenestrated toy embodiment of the T-2 module.

Figure 78:
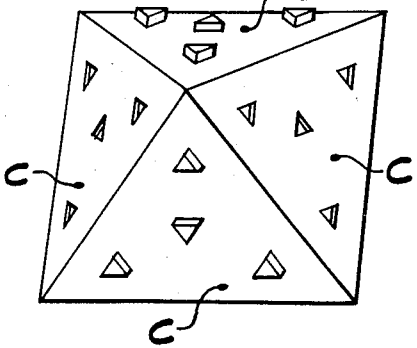

FIG. 78 represents a perspective view like that of FIG. 77, illustrating the half-size unfenestrated toy embodiment of the T-2 module.

Figure 79:
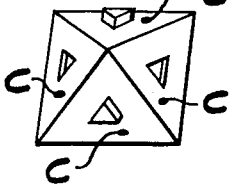

FIG. 79 represents a perspective view, like FIGS. 77 & 78, illustrating the quarter-size unfenestrated toy embodiment of the T-2 module.

Figures 80, 81, 82:
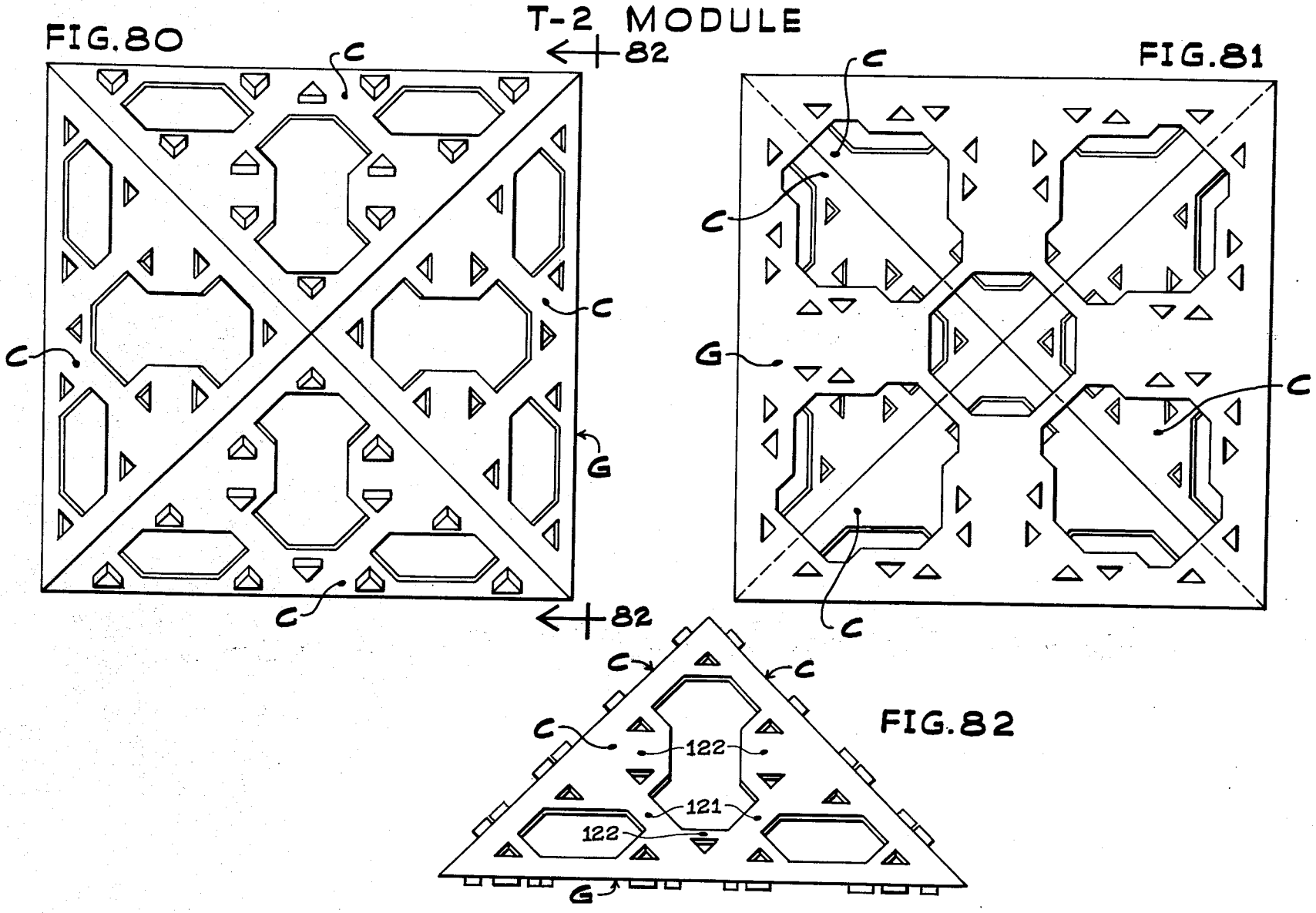

FIG. 80 represents a geometric view of the fenestrated T-2 module shown in FIG. 75, with the square G wall thereof underneath at a right angle to the line-of-view, and with the four C walls thereof facing the viewer.

FIG. 81 represents a geometric view of the fenestrated T-2 module shown in FIGS. 75 & 80, with the line-of-view 180° from that of FIG. 80, namely, with the square G thereof facing the viewer at a right angle to the line-of-view.

FIG. 82 represents an elevational view of the fenestrated T-2 module shown in FIGS. 75, 80 & 81, as viewed on line 82—82 of FIG. 80.

Figures 83, 84, 85:
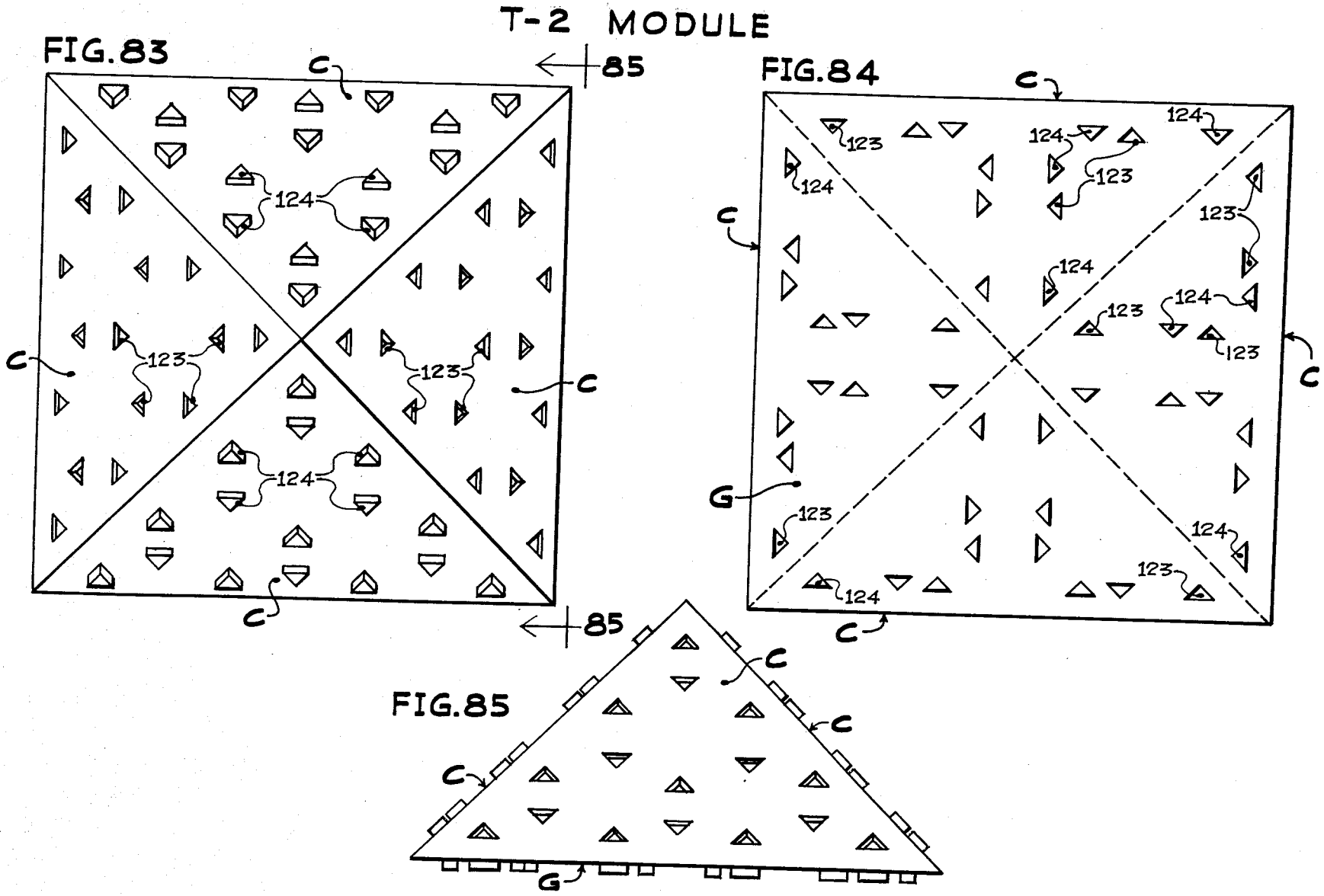

FIG. 83 is a geometric view, like that shown in FIG. 80, of the unfenestrated T-2 module shown in FIG. 77.

FIG. 84 represents a geometric view like FIG. 81, of the unfenestrated T-2 module shown in FIGS. 77 & 83.

FIG. 85 represents an elevational view of the unfenestrated toy embodiment of the T-2 module T-2, as viewed on line 85—85 of FIG. 83.

Figure 86:
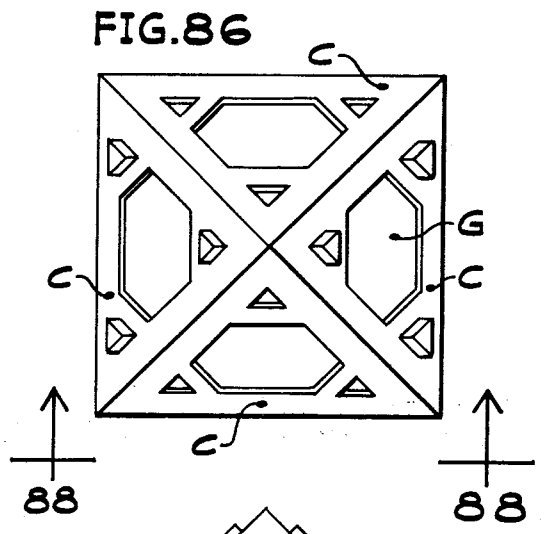

FIG. 86 represents a view like FIG. 80, illustrating the half-size fenestrated toy embodiment of the T-2 module.

Figure 87:
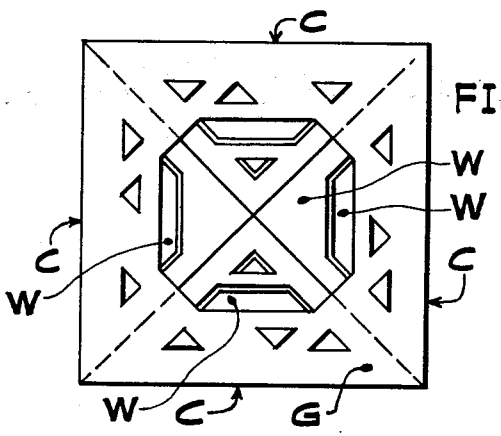

FIG. 87 represents a view like FIG. 81, illustrating the half-size fenestrated toy embodiment of the T-2 module.

Figure 88:
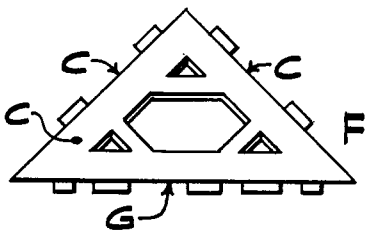

FIG. 88 represents an elevational view on line 88—88 of FIG. 86.

Figure 89:
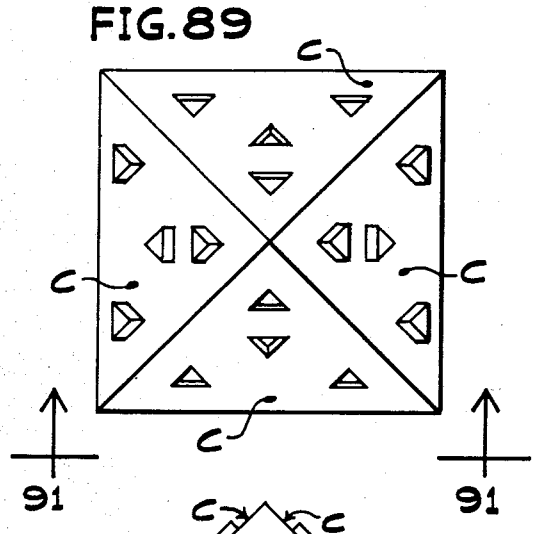

FIG. 89 represents a view like FIG. 83, illustrating the half-size unfenestrated toy embodiment of the T-2 module.

Figure 90:
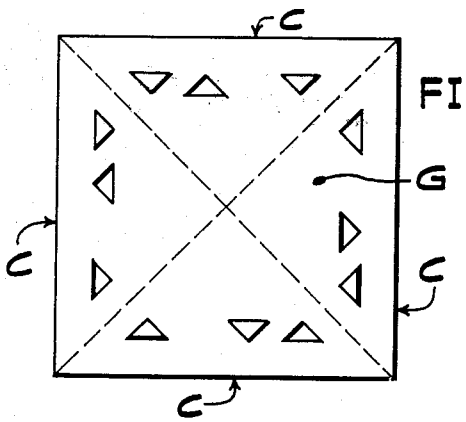

FIG. 90 represents a view like FIG. 84, of the half-size unfenestrated embodiment of the T-2 module.

Figure 91:
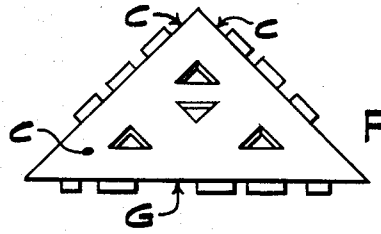

FIG. 91 represents an elevational view on line 91—91 of FIG. 89.

Figure 92:
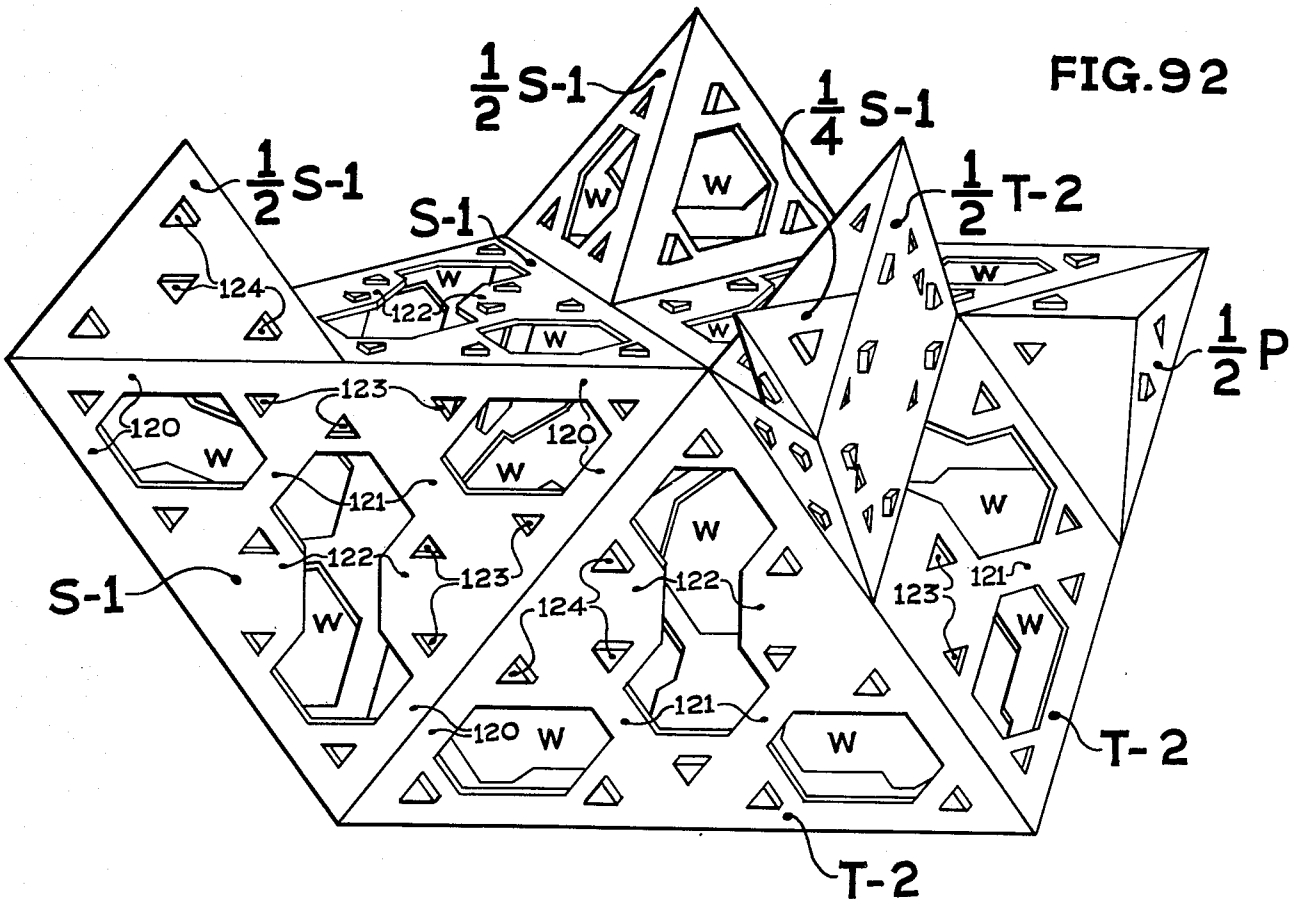

FIG. 92 represents a perspective view (viewed from above and from the front) of a multi-module structure of the toy embodiment of the present invention, including a full-size fenestrated T-2 module, a full-size fenestrated S-1 module with a C wall thereof contacting a C wall of the T-2 module, and with an unfenestrated half-size S-1 module detachably secured to the full-size fenestrated S-1 module, and with a fenestrated S-1 module detachably secured to one of the C walls of the fenestrated T-2 module and with an unfenestrated half-size T-2 module detachably mounted to another C wall of the full-size fenestrated T-2 module and with an unfenestrated half-size P module detachably mounted to the same last mentioned C wall of the T-2 module and with a quarter-size S-1 module detachably secured to one of the C walls of the unfenestrated half-size T-2 module.

Figure 93:
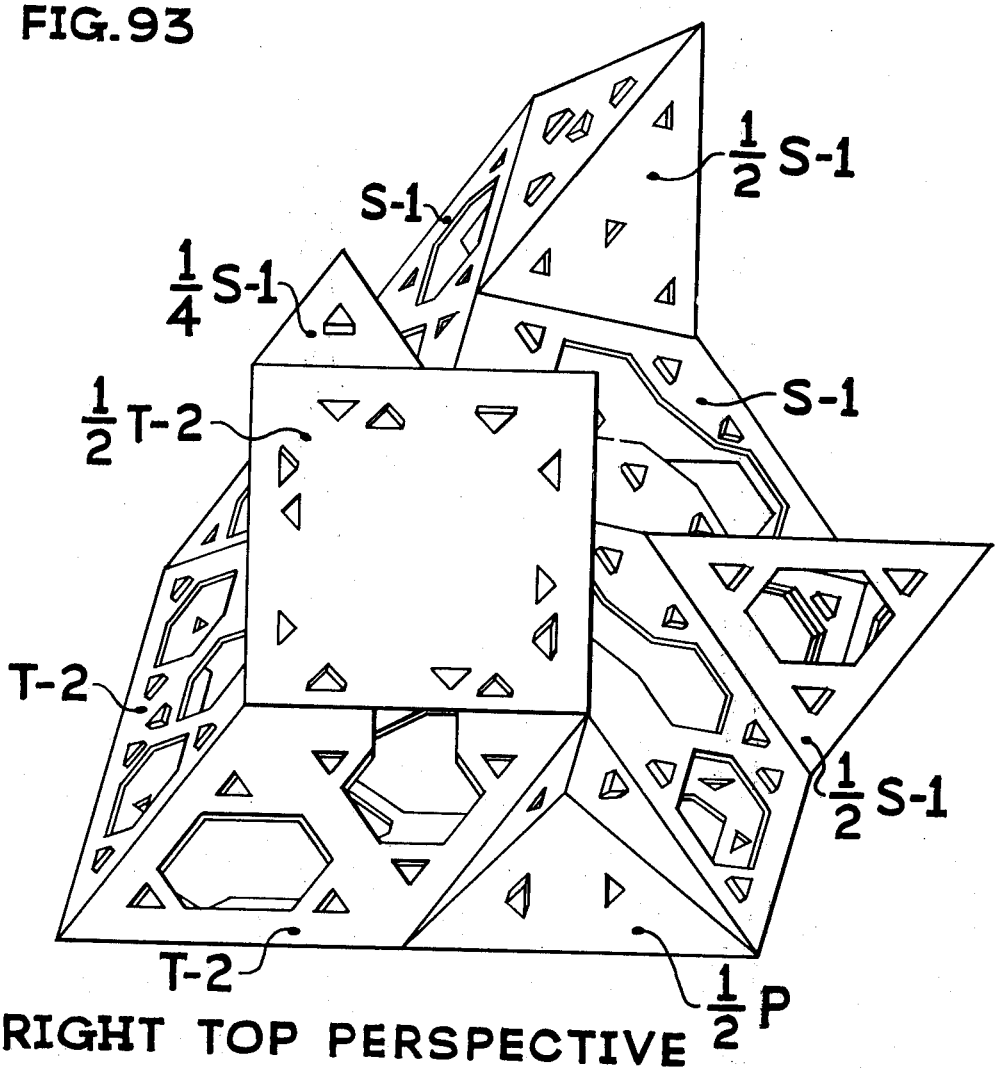

FIG. 93 represents a perspective view of the multi-module structure shown in FIG. 92, but viewed from above (at an angle) and from the side which is the right side in FIG. 92.

Figure 94:
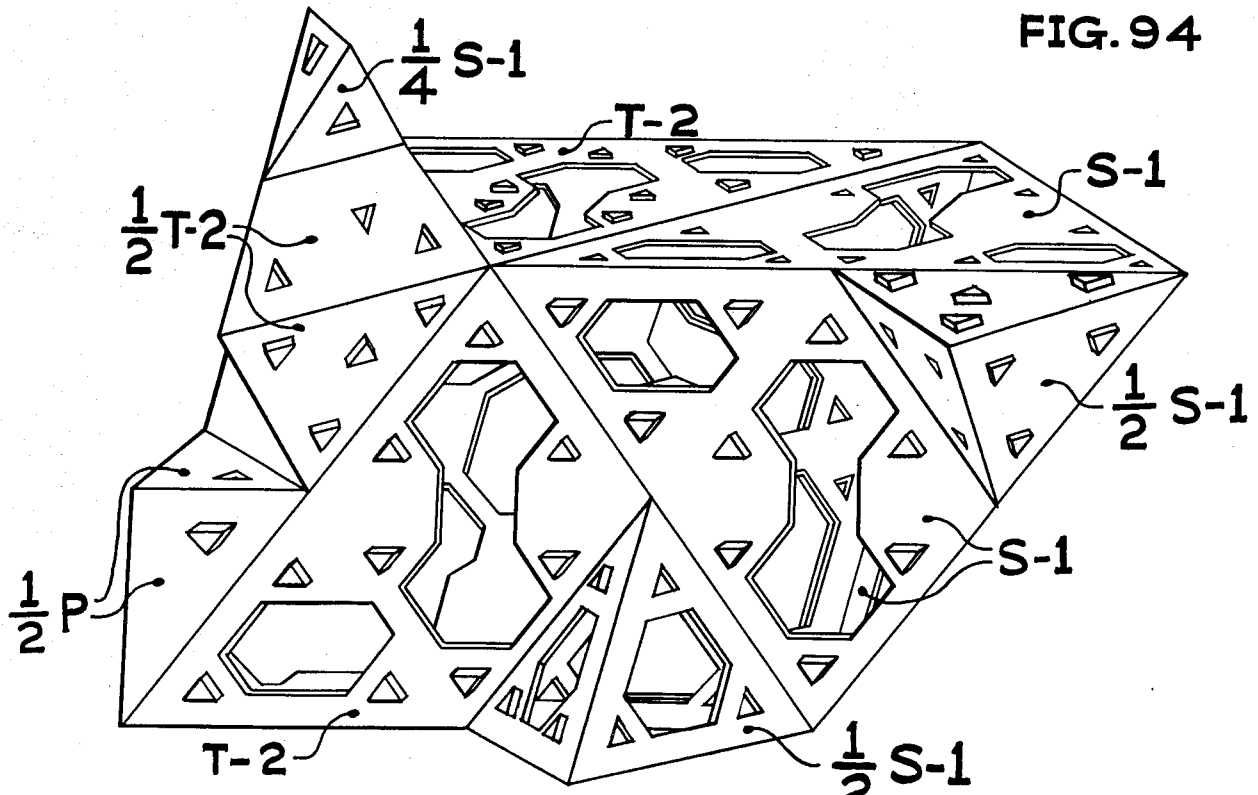

FIG. 94 represents another perspective view of the multi-module structure shown in FIGS. 92 & 93, but viewed at an angle from above and from the rear.

Figure 95:
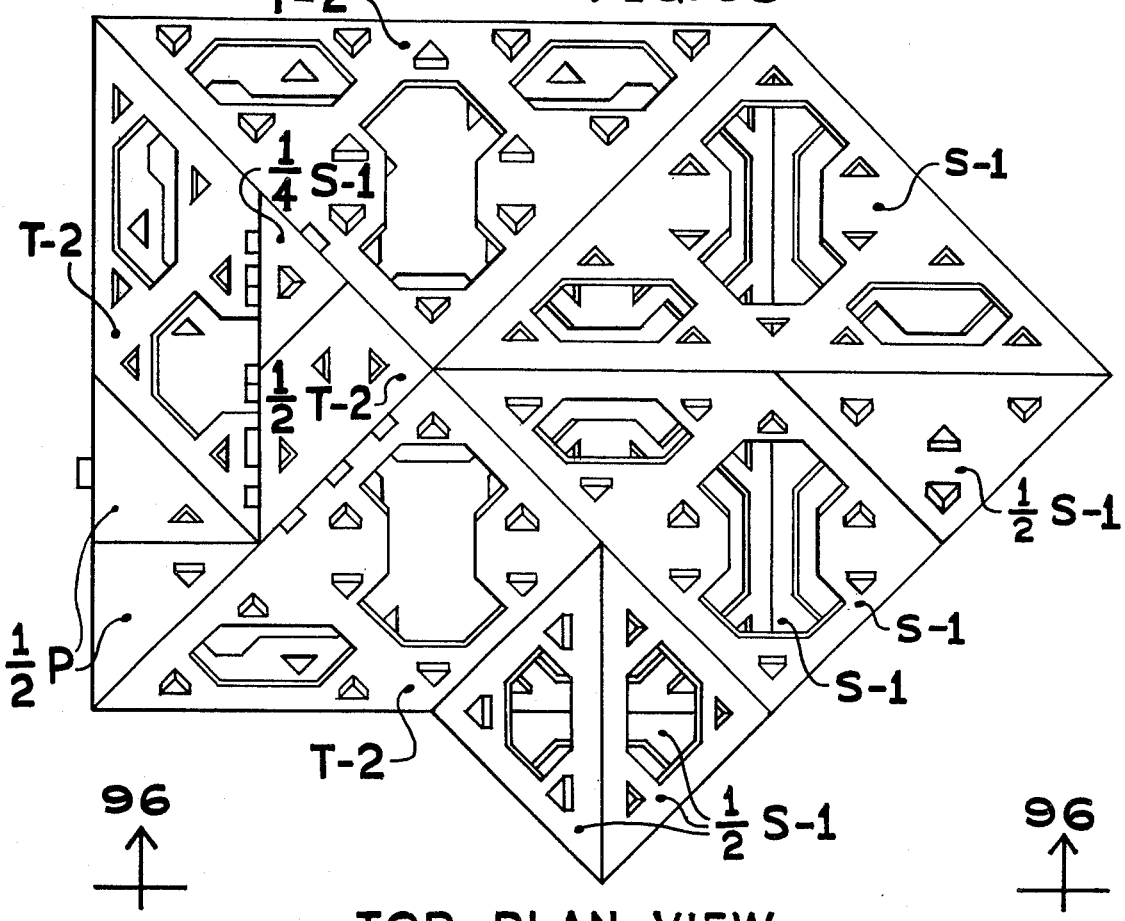

FIG. 95 represents a geometric top plan view of the multi-module structure shown in FIGS. 92, 92 and 94, along a line-of-view which is at a right angle to the full-size fenestrated T-2 module thereof.

Figure 96:
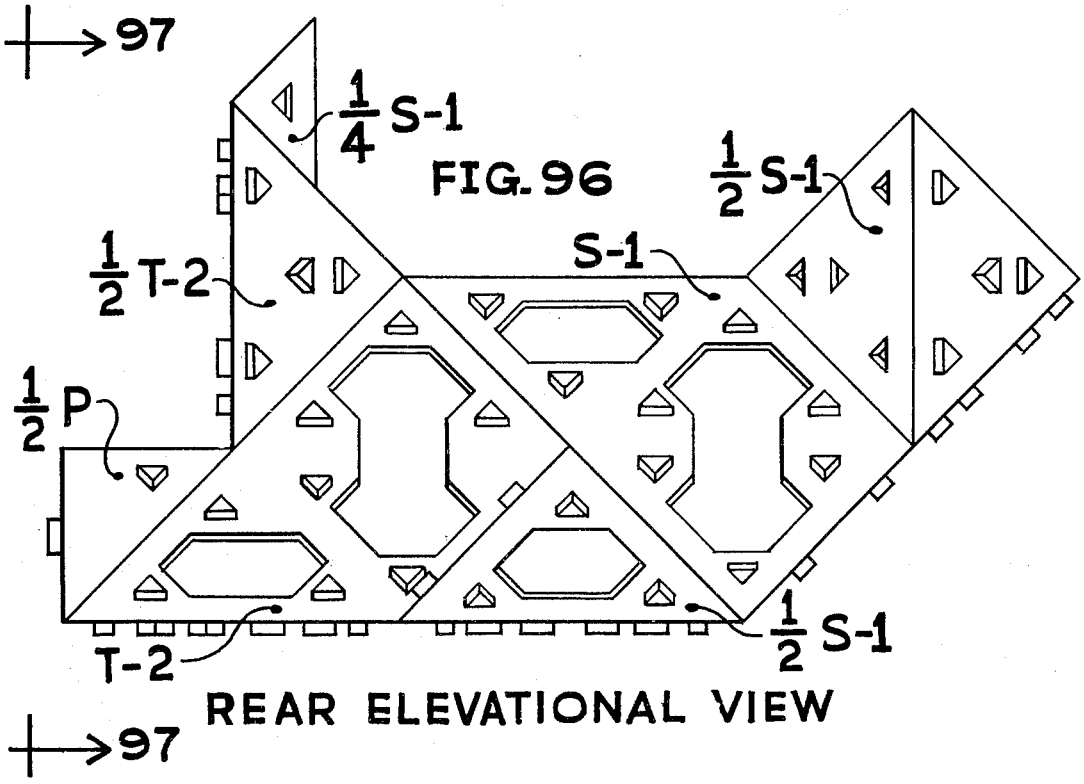

FIG. 96 represents a rear-elevational geometric view of the multi-module structure shown in FIGS. 92–95.

Figure 97:
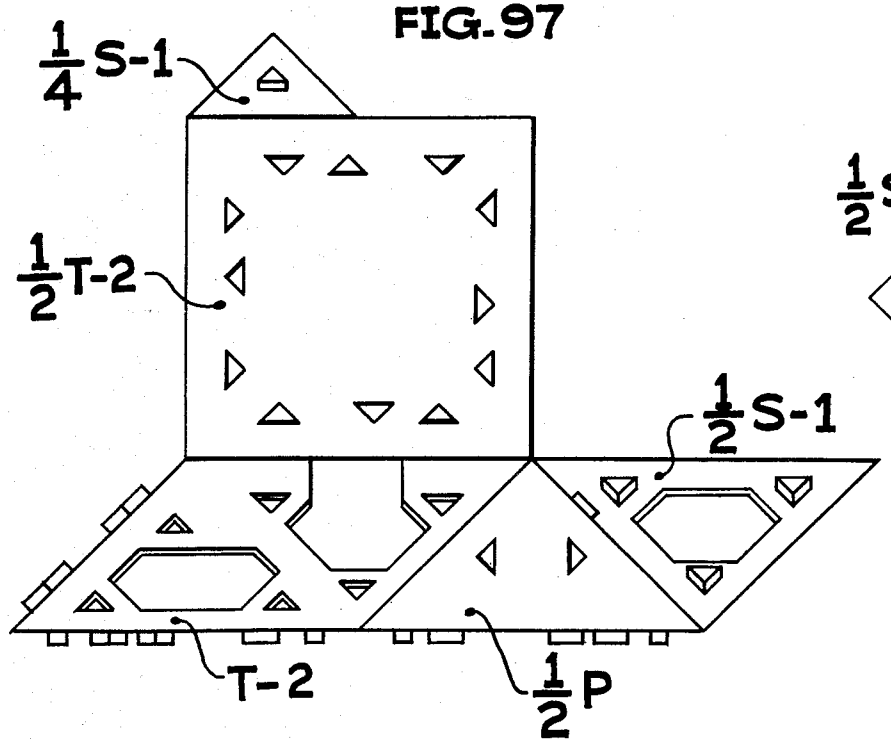

FIG. 97 represents a right end elevational geometric view of the multi-module structure shown in FIGS. 92–96, viewed on line 97—97 of FIG. 96.

Figure 98:
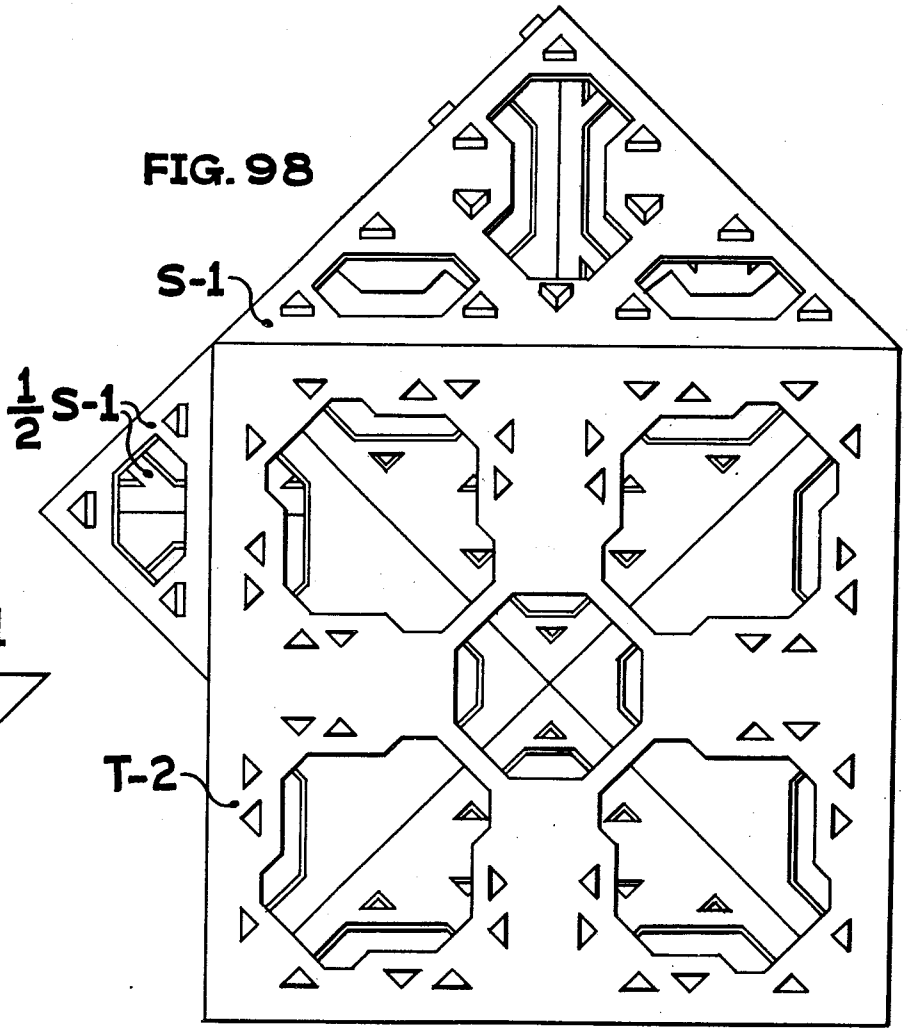

FIG. 98 is a bottom geometric view of the multi-module structure shown in FIGS. 92–97, namely, a view along a line-of-view which is 180° from the line-of-view of FIG. 95.

Figure 99:
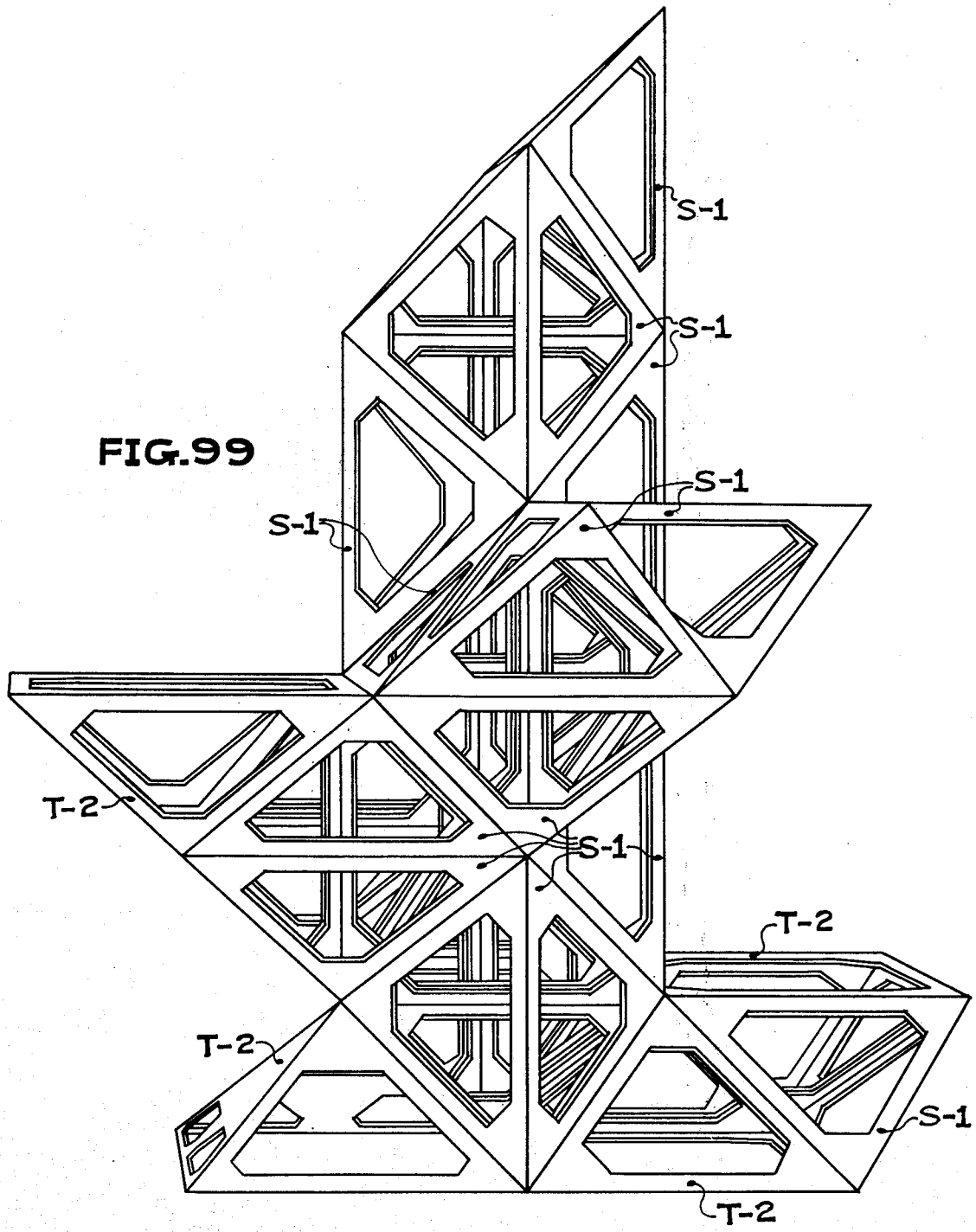

FIG. 99 represents a front elevational perspective view illustrating a multi-module structure of the playground-equipment embodiment of the present invention, with the inter-module fasteners and the holes therefor being omitted for greater clarity (such fasteners being shown in FIGS. 109 to 114).

Figure 100:
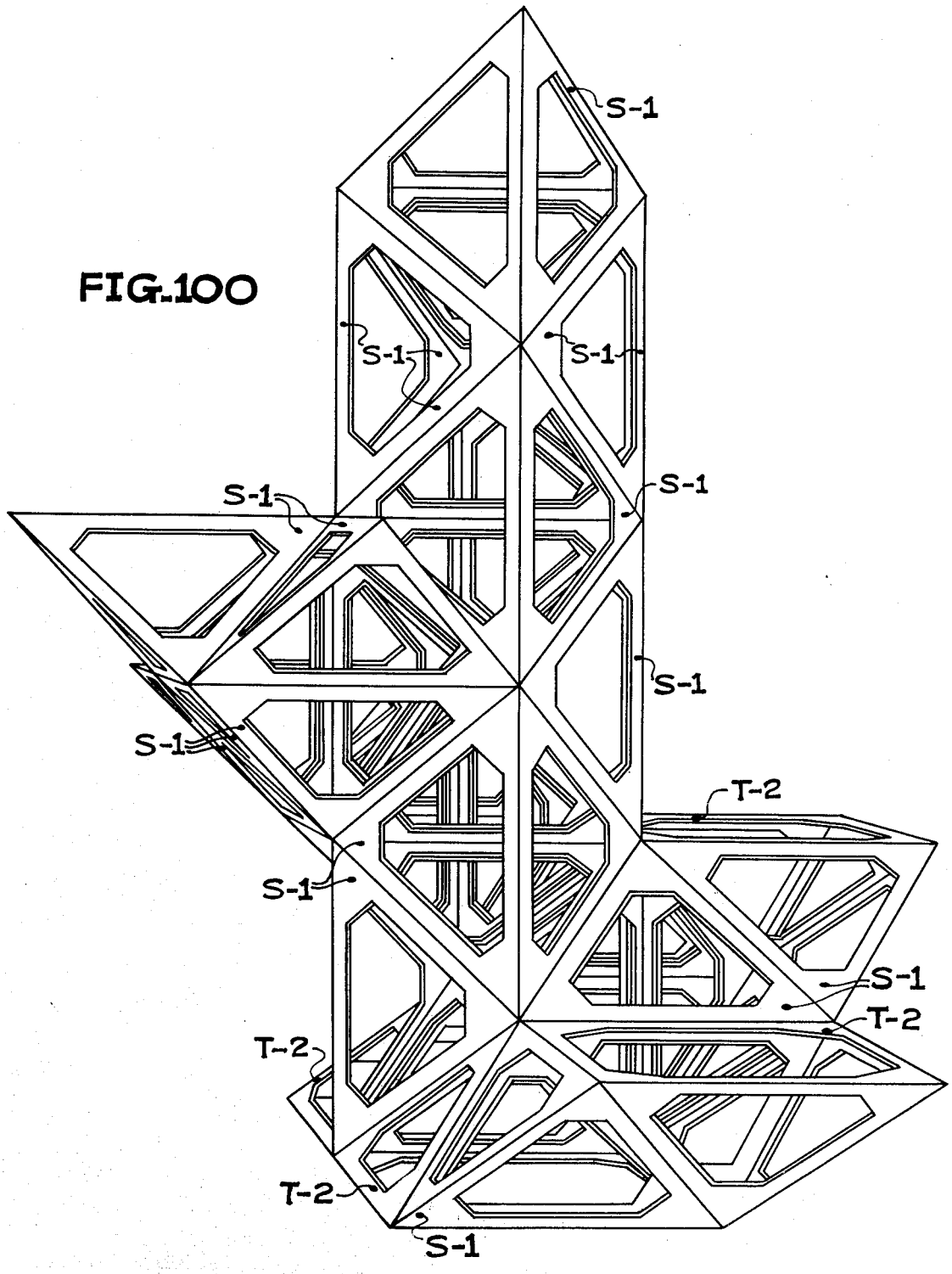

FIG. 100 is a right side elevational perspective view of the multi-module structure shown in FIG. 99.

Figure 101:
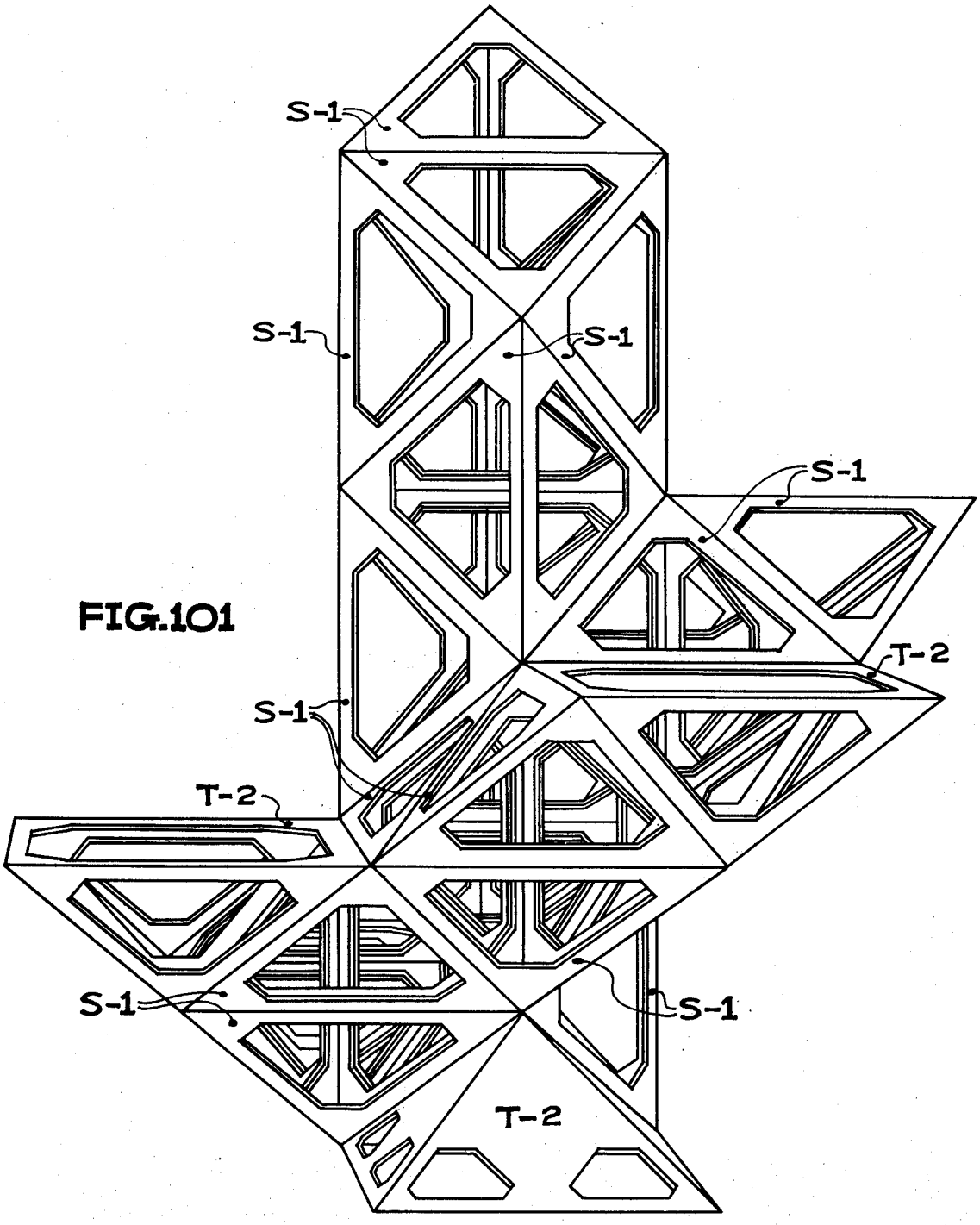

FIG. 101 represents a left elevational perspective view of the multi-module structure shown in FIGS. 99 & 100.

Figure 102:
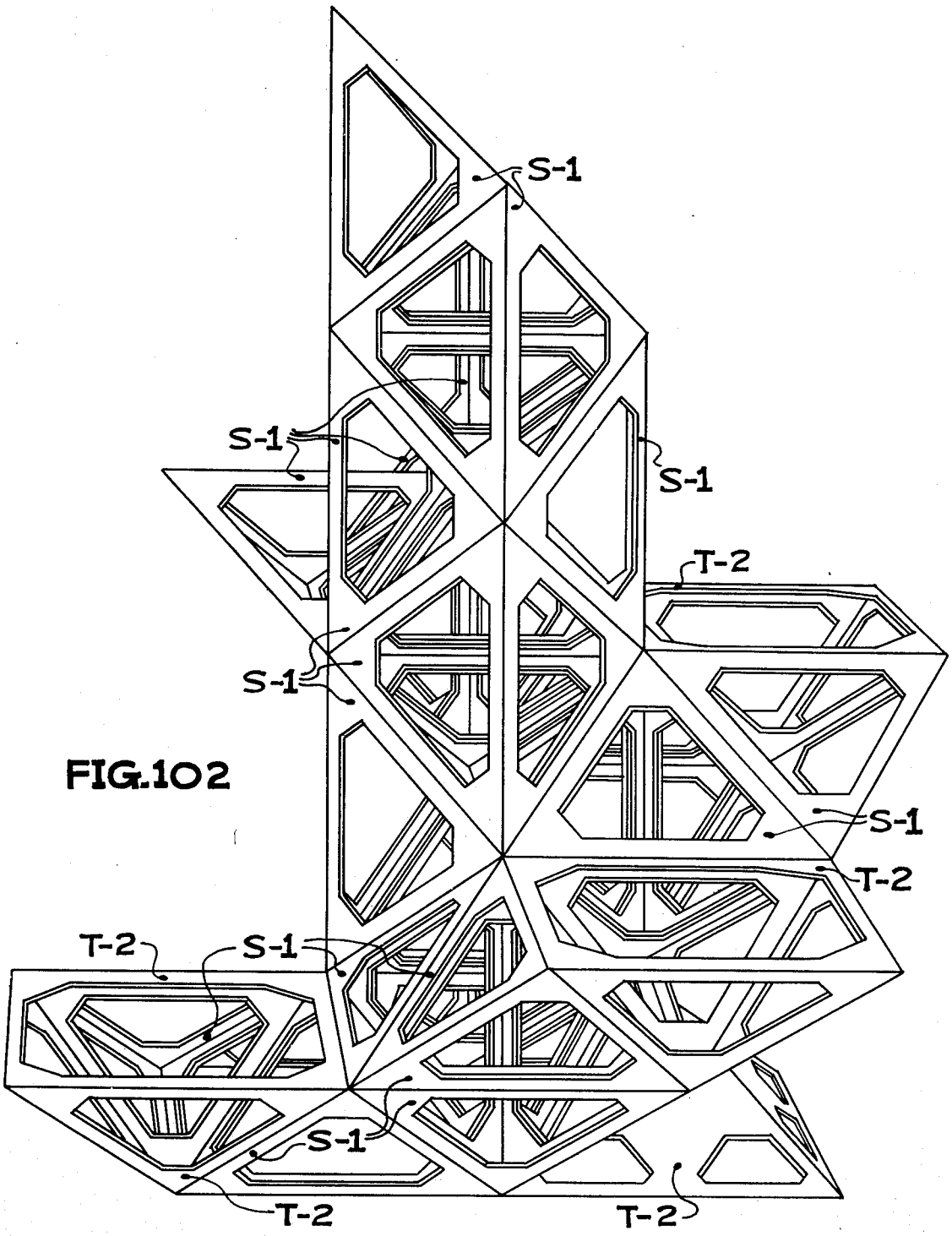

FIG. 102 represents a rear elevational perspective view of the same.

Figure 103:
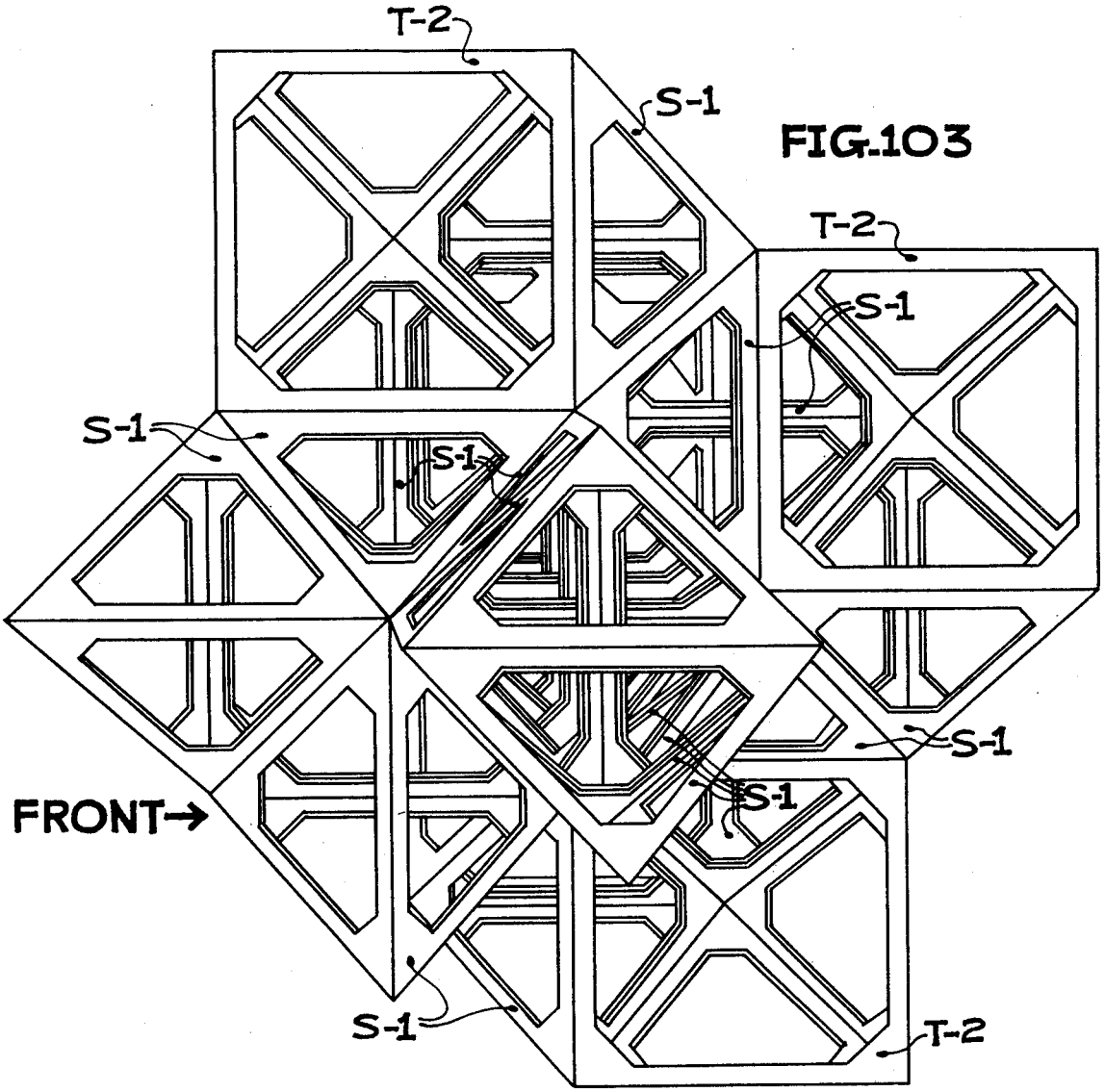

FIG. 103 represents a top perspective view of the multi-module structure shown in FIGS. 99 to 102.

Figure 104:
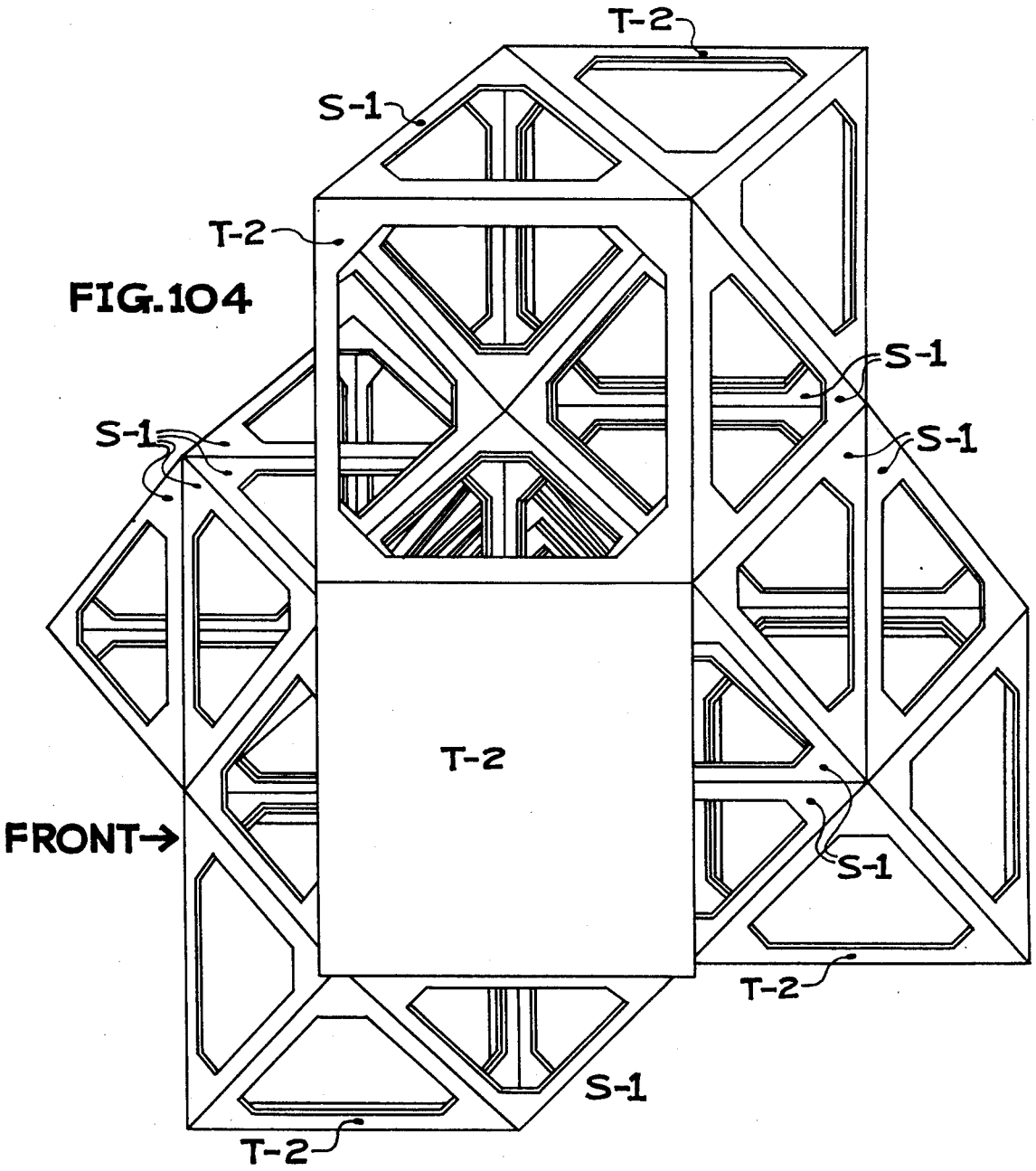

FIG. 104 represents a bottom perspective view of the multi-module structure shown in FIGS. 99–103.

Figures 105, 106, 107, 108, 109, 110:
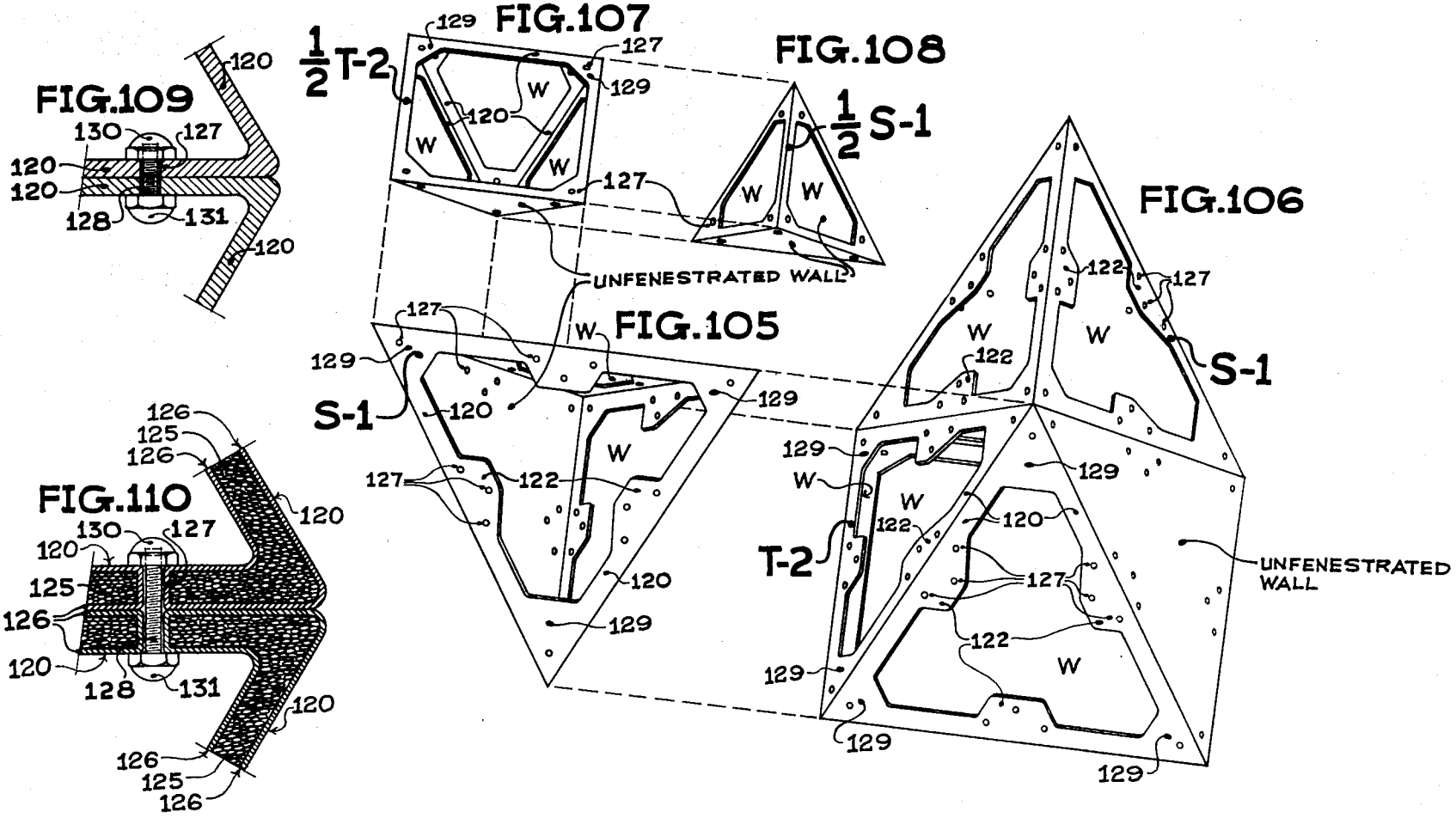

FIG. 105 represents a perspective view of an S-1 playground equipment module, with three of its C walls fenestrated and one C wall thereof unfenestrated, and illustrating the widening of the flanges bordering the fenestrations, along mid-points of the flanges, and illustrating the fastener-receiving holes in the flanges as well as in the unfenestrated C wall thereof.

FIG. 106 represents a perspective view of a multi-module playground equipment structure formed of a lower T-2 module and an upper S-1 module (with the fasteners not shown; one of the C walls of the S-1 module being in registration and contact with one of the C walls of the T-2 module. The dotted lines between FIG. 106 and FIG. 105 are to indicate the further option of attaching another S-1 module to the T-2 module.

FIG. 107 represents a perspective view of a half-size T-2 playground equipment module, with the square bottom wall and one of the C walls of this module facing the viewer (at angles).

FIG. 108 is a perspective view of a half-size playground equipment module S-1, viewed generally at the same angle as that of the full-size S-1 module in FIG. 106. The dotted lines beneath FIG. 107 indicate the option of fastening the unfenestrated C wall of the half-size T-2 module of FIG. 107 to one of the C walls of the full-size module S-1. The dotted lines between FIGS. 107 and 108 indicate the further option of mounting the half-size S-1 module of FIG. 108 to one of the C walls of the half-size T-2 module of FIG. 107.

FIG. 109 represents a fragmentary cross-section through contiguous wall-flanges and walls of any two playground-equipment modules (of any size) detachably secured to each other by a capheaded bolt and a cap nut; illustrating one embodiment of the telescopic fastener means intermediate contiguous walls or wall-flanges of any two playground-equipment modules mounted to each other.

FIG. 110 represents a similar fragmentary cross-section of playground-equipment modules detachably secured to each other but further illustrating that embodiment of the playground-equipment modules in which the walls and wall-flanges thereof of the modules have a low-density or light-weight cellular core portion between opposite higher-density and impact resistant plastic layers.

FIG. 111 represents a fragmentary cross-section similar to that shown in FIG. 109, but illustrating an alternative telescopic connector or fastener means intermediate the two wall-flanges of the two modules mounted to each other.

FIG. 112 represents a perspective view of another embodiment of the fastener or connector means shown in FIG. 111, but including snap abutments at its ends.

FIG. 113 represents another fastener or connector means similar to that shown in FIG. 112, but without serrations or notches.

FIG. 114 represents another form of fastener or connector means similar to that shown in FIG. 113, but including a thin central flange integral with the fastener and having, at its opposite ends collapsable eyelets.

Figure 115:
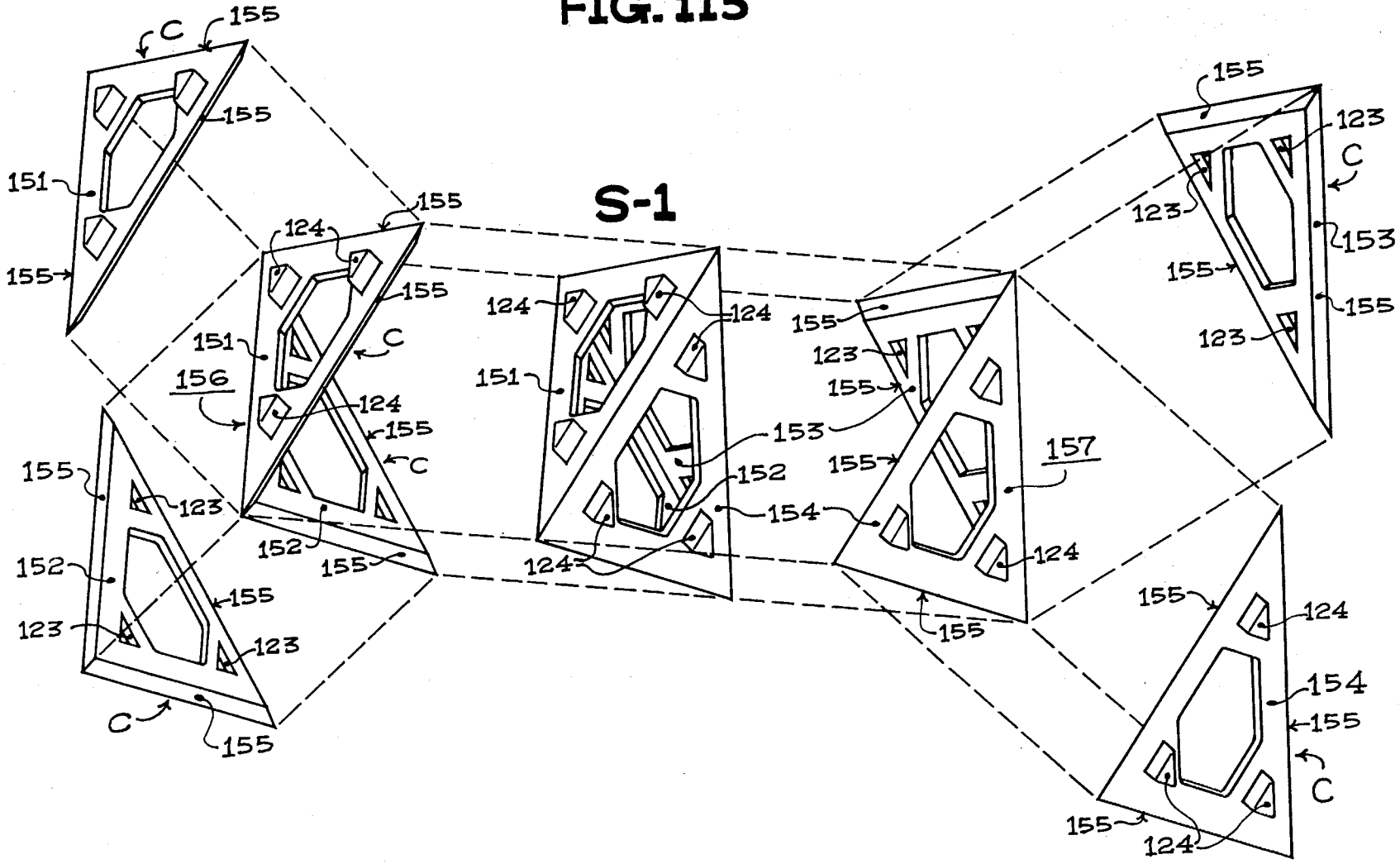

FIG. 115 represents a multi-stage exploded view of an S-1 module, illustrating a manner in which (fenestrated or unfenestrated) hollow modules may be formed of individual or pairs of walls thereof by first stamping or molding such walls either singly or in pairs, with bevelled edges, and thereafter fusing, welding or adhesively adhering the juxtaposed bevelled edges of the walls to each other to form the hollow polyhedron module.

Figure 116:
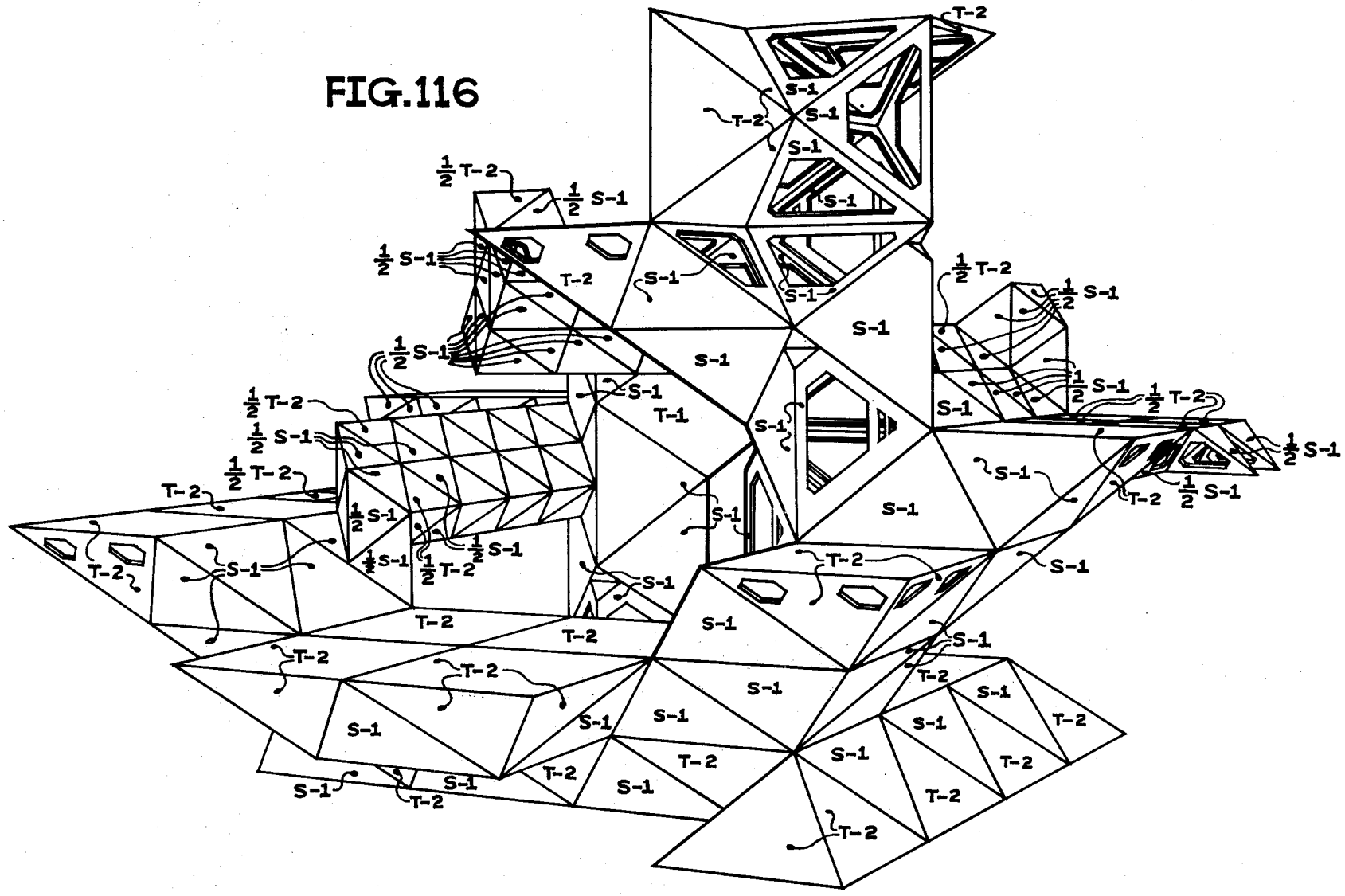

FIG. 116 represents a perspective view of a building composed of full-size and half-size modules S-1, T-1 & T-2.

Figure 117:
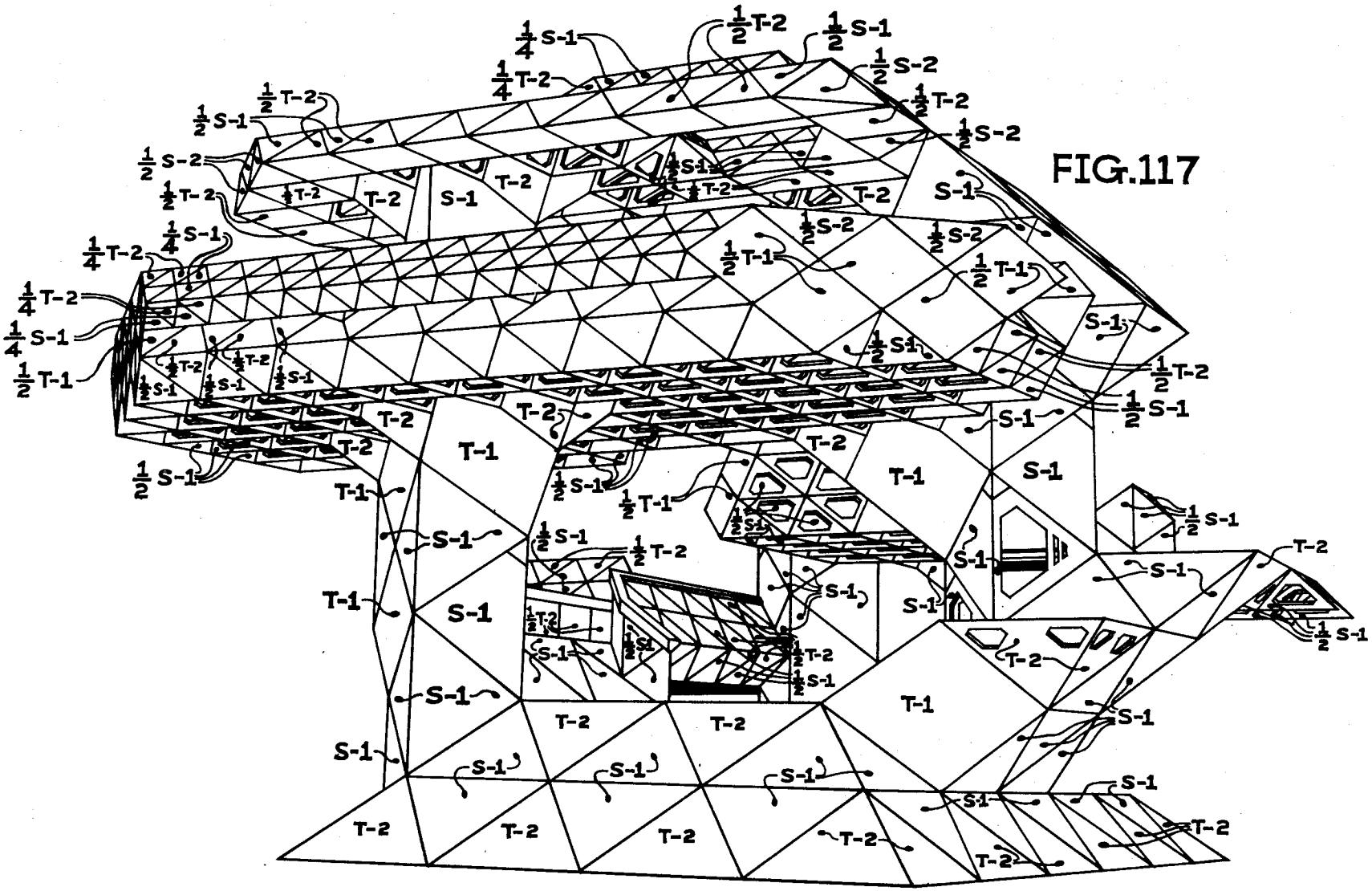

FIG. 117 represents a perspective view of a building which is an extension or an enlargement of the building shown in FIG. 116, including also half-size S-2 modules and quarter-size S-1 modules and quarter-size S-2 modules and quarter-size T-2 modules.

DESCRIPTION OF THE INVENTION

FIGS. 1 to 29, inclusive, illustrate the fenestrated hollow embodiments of the aforementioned modules P, S-1, S-2, S-3, T-1, T-2 & T-3. In these embodiments, portions of the walls of the hollow modules are omitted or partly cut away to form openings or windows W therein, surrounded by wall-flanges 120, which in effect constitute the fenestrated embodiments of the aforementioned walls A, B, C, D, E, F, G & H, respectively, of such hollow modules. The fenestrated walls of such hollow modules may each have a single opening or window W therein, as illustrated in FIGS. 1, 2, 60, 76, 87, 88, 99-104 & 105-108, or such fenestrated walls may have several windows W therein as illustrated in FIGS. 30, 32, 37–40, 51, 53, 55, 59, 63–65, 67–68, 75, 80–81 & 92–98. The multi-windowed walls have wall-webs 121 intervening the outer marginal wall-flanges 120, to form several window W in such walls.

The outer marginal wall-flanges 120 as well as the invervening wall-webs 121 may also have enlarged or widened portions of enlargements 122, as indicated in FIGS. 30, 31, 38-39, 55, 59, 63–68, 75 & 80–82, for the reception of the inter-module fastening means.

Corner-webs 129 are preferably provided intermediate the meeting ends of the wall-flanges 120 of the fenestrated walls, both to render the fenestrated hollow modules more resistant to twisting and other deformation and also to receive the module-connecting fastening means illustrated in FIGS. 105 to 114, inclusive, or to receive the module-connecting recesses 123 and projections 124 in the erector-toy embodiments of the invention, as illustrated in FIGS. 30–32, 34, 37–41, 45–46, 55, 56, 59, 60, 63–68, 75, 76, 80–82, 86–88 & 92–98.

In the erector-toy embodiment illustrated in FIGS. 30 to 98, the full-size modules are preferably hollow, with some or all of their walls fenestrated. The half-size modules may be solid or hollow, and if hollow may have some or all of their walls fenestrated. The quarter-size modules of the erector-toy embodiment may be solid or hollow, with all their walls unfenestrated.

In the erector-toy embodiment, the modules are formed of a suitable form-retaining synthetic-resin plastic having a slight resiliency so that the projections 124 on a wall of one module may be telescoped into the registering recesses 123 of the corresponding wall of another module with sufficient interference-fit or with sufficient frictional engagement to form an adequate though detachable interconnection between modules when the projections 124 are so telescoped into the registering recesses 123.

In the playground-equipment embodiment, the modules are preferably formed with suitable synthetic resin plastic having a slight resiliency and preferably reinforced with glass fiber or other suitable reinforcement dispersed therethrough. The hollow modules may either be formed of single-ply walls as indicated in FIGS. 109 and 111 of multi-ply walls as indicated in FIG. 110. The single-ply walls may be formed of a suitable form-retaining or slightly resilient synthetic-resin plastic and such walls may have glass-fiber dispersed therethrough to reinforce the walls against breakage upon impact. The plastic may also be an impact-resistant plastic. The walls of the module may also be formed of ply-wood or light-weight particulate board or flake board. The walls of the playground modules may be of uniform density throughout as illustrated in FIG. 109, or the walls may have a core portion 125 of expanded or cellularly formed plastic, flanked by non-cellular or less cellular or solid surface-portions or surface layers 126 integral with or fused to the cellular core 125. The cellular core 125 and solid skin portions 126, together form a strong light-weight and impact-resistant wall, illustrated in FIG. 110.

In the playground-equipment embodiment, the wall-flanges 120 and flange-enlargements 122 and corner-webs 129 are provided with round or polygonal fastener-receiving holes 127 as illustrated in FIGS. 105–111. Through such holes 127, a bolt 128 is extended having a rounded or cap-like head 131 onto the free projecting end of which a cap 130 is threaded.

The bolt 128 and a nut 130, may be injection-molded or otherwise formed of a suitable impact-resistant synthetic resin plastic which may be reinfored with glass fibers or the like.

The modules may be molded, cast or otherwise formed of a suitable impact-resistant and fire-resistant or fire-retardant synthetic-resin plastic with or without fibre glass or other suitable reinforcement therein.

In FIGS. 9 to 29, the secondary and tertiary modules are shown as being composed of primary modules, and hence some of the outer walls of such secondary and tertiary modules contain wall-flanges 132 intermediate the peripheries thereof, as illustrated in FIGS. 9, 10, 12, 13, 16, 17, 18, 25 & 26, and the modules T-1, T-2 & T-3 also contain internal flanges 133 as illustrated in FIGS. 18, 22, 25 & 26. Such intermediate wall-flanges 132 and internal flanges 133 are constituted of wall-flanges 121 of the primary module P.

For the enhancement of its educational and instructional value, it may be preferable to form the secondary modules of two primary modules and to form the tertiary modules of four primary modules or of two secondary modules. However, I may also provide secondary modules which are integral or one-piece units, and I may likewise provide tertiary modules which are integral or one-piece units, and in such one-piece units I may omit the aforementioned wall-flanges 132 which are intermediate the periphery of a wall of a secondary module of a tertiary module, and I may also omit the aforementioned wall-flanges 133 which are entirely internal of the tertiary modules shown in FIGS. 18, 22, 25 & 26.

Thus, for the playground equipment (and perhaps also for the smaller size erector toy) I may provide both the primary module from which the secondary and tertiary modules may be formed through various assemblies thereof, and I may also provide integral or one-piece secondary and tertiary modules which can be used for constructing larger structures representing towers, buildings, bridges, etc.

In the playground structures it is desirable to provide access for the child into and through the module and hence the fairly large size modules indicated hereinabove are provided. The integral or one-piece secondary modules and tertiary modules (with the aforementioned intervening wall-flanges 132 & 133 ommitted) permits the reduction of the over all size of such modules while still permitting adequate access for the child into and through the module not only for purposes of assembly and disassembly but also for exercise.

The smaller size erector-toy embodiment of my invention, illustrated in FIGS. 30 to 98, is likewise composed of the aforementioned primary, secondary and tertiary modules, although one or more of the secondary and tertiary modules may be ommitted. In the erector-toy embodiment, the modules may either be solid or hollow. Thus, the larger-scale modules of the erector-toy may be hollow, with only marginal wall-flanges or with marginal wall-flanges and intervening wall-webs, while the smaller scale modules of the same set and particularly the smallest scale modules of the set may be solid units or pieces.

Whether the erector-toy modules are solid or hollow, some of the walls of the module are provided with one, two or three (or more) recesses 123 while other walls of the module are provided with corresponding projections or corresponding dowel-like projections or knobs 124 spaced in relation to each other and in relation to the boundaries of the wall so as to match the spacing of the recesses 123 of the corresponding wall to be mated therewith. Thus, for instance, the A wall of one primary module is provided with spaced recesses 123 while the A wall of another module is provided with correspondingly-spaced projections 124 which can be inserted into the recesses 123 of the A wall of the first-mentioned module with sufficient interference-fit to secure the two A walls to each other with sufficient retention and yet with sufficient separability to permit the two primary modules to be attached to each other and to be detached from each other.

Similarly, one of the B walls of a primary module is provided with the aforementioned recesses 123 while the other B wall of the same module is provided with the aforementioned projections 124. In like manner, the C wall of one module is provided with the recesses 123 while the C wall of another module is provided with the aforementioned projections 124.

Where two or more recesses 123 are provided in one wall and a corresponding number of projections or knobs 124 provided on the matching wall of another module, the recesses and knobs may be circular or cylindrical, whereas if but a single projection and knob 124 is provided in the matching walls, as in the smallest scale modules, then the recess and knob are of polygonal shape so as to prevent rotation of the two walls in relation to each other about the axis of the recess and knob 124.

Furthermore, in order to permit a smaller scale module to be attached so as to cover a fractional portion of the wall of a larger scale module, it is preferable to make all recesses 123 and knobs 124 of polygonal cross-section.

FIGS. 111 to 114 (inclusive) illustrate another form of telescopic inter-module fastening means of the playground-equipment embodiment of my invention. This fastener comprises a flexible and bendable elongated member, 135, 136 or 137 formed of a strong but flexible and bendable plastic or an elastomer, as indicated in FIGS. 111 to 114 (inclusive).

Each of the three forms 135, 136 & 137 of such fastener includes an enlarged central portion 138 of rectangular or round cross-section having two prong-receiving holes 139 & 140 extending therethrough, with the distance between the far-sides of said holes being equal to or slightly less than the combined thicknesses of two wall-flanges 120 plus the combined thickness of the two prong-ends 146 & 147, except that in the case of the fastener 137 (FIG. 114) the distance between the far-sides of the two-holes 139 & 140 is equal to (or slightly less than) the combined thicknesses of two wall-flanges 120 plus the combined thicknesses of the two prong-ends 146 & 147 plus the thickness of the spacer or washer 141, which may be formed integrally with the fastener. Each of the fasteners 135, 136 & 137 includes two opposite flexible prongs or dowel-like members or cotter-like members 142 & 143, extending outwardly (in opposite directions) from the enlarged central portion 138. These opposite prongs or extensions 142 & 143 are adapted to be bent into loops 144 & 145, and the free ends 146 & 147 thereof are adapted to be wedgingly inserted into the holes 139 & 140, respectively, as indicated in FIG. 111, thereby to hold the two wall-flanges 120 in assembled relation to each other.

In applying the fastener (135, 136 or 137), one of the two elongated prongs or dowel-like or cotter-like extensions (142 or 143) is first formed into a loop (144 or 145) and its free end is inserted through the corresponding hole (139 or 140) until the spring-latch 148 or the compressible enlarged eyelet 149 has passed through the hole, thereby forming an abuttment resisting the withdrawal of such end from the hole.

Thereafter, the other elongated prong or dowel-like or cotter-like extension (142 or 143) is telescoped through the two aligned holes 127 in the two wall-flanges 120, and is pulled until the prong-end (147 or 148) previously inserted into its corresponding hole (139 or 140) is brought tight up against the outer surface of the wall-flange 120 adjacent thereto. Thereupon, the theretofore unfastened prong is inserted into the corresponding hole (139 & 140) until the spring latch 148 or the compressible enlarged end 149 thereof has passed through the hole and serves as an abuttment to resist the withdrawal of such end from the hole.

The latch-end 148 or the compressible-end 149 is preferably tapered, to a suitable extent, so as to provide a reduced and tapered lead portion at its outermost end, which facilitates the insertion of the second prong (142 or 143) into its corresponding hole (139 or 140).

One of the two prongs (142 or 143) may be replaced by a plain head similar to the head of a rivet or the like.

The prongs or extensions 142 and 143 may be notched at suitable intervals, and to a suitable depth, to increase their flexibility, as indicated in FIGS. 111 and 112.

I may also provide a relatively thin spacer or washer 141, between the two holes 139 and 140, integral with the enlarged central portion 138 of the fastener, to fit between the two wall-flanges 120, thereby to center the fastener in relation to the two wall-flanges and also to maintain a slight spacing between juxtaposed wall-flanges of the so fastened modules.

FIG. 115 illustrates a method of making the hollow module of individual walls (151, 152, 153 & 154) or pairs of walls (156 & 158) thereof without having integrally to mold the hollow module with the aid of a complex multi-piece internal mold-core which must be removed through a window of the module.

While in FIG. 115 I have illustrated a method of so making the module (out of single walls or pairs of walls) as applied to the S-1 module, this method is equally applicable to the making, in a similar manner, of each of the other modules.

Likewise, while in FIG. 115 I have illustrated a making of a module of the erector-toy embodiment of my invention, I may in like manner make the playground equipment module in like manner.

I may first separately mold the individual walls 151, 152, 153 & 154 of the module and then unite two such individual walls with each other to form the 2-wall assemblies 156 & 157, respectively, and thereafter unite with or assemble to each other the two 2-wall units 156 & 157 to form the finished module shown in the center of FIG. 115.

I may also, in the first instance, mold, in one molding operation, the multi-wall unit, as, for instance, the 2-wall unit 156 and the 2-wall unit 157, without first molding the individual or single walls (151, 152, 153 & 154) thereof. The so integrally molded 2-wall or multi-wall units 156 & 157 are then united with or assembled to each other to form the finished module shown in center FIG. 115.

Where the module is formed of the separately molded single walls thereof, as, for instance, the separate single walls 151, 152, 153 & 154, some or all of the edges 155 of the walls may be matchingly beveled. Where the module is formed of 2-wall or multi-wall units or sub-assemblies, as, for instance, the multi-wall sub-assemblies 156 & 157, some or all of their exposed edges 155 may be matchingly beveled.

The separately molded single walls, of the module, as, for instance, the walls 151, 152, 153 & 154, are united with or assembled to each other along their juxtaposed matching edges 155 to form the 2-wall or multi-wall sub-assemblies of the module, as, for instance, the sub-assemblies 156 & 157. The multi-wall sub-assemblies exemplified by 156 & 157 (whether integrally molded or formed by uniting the separately molded walls thereof) are united with or assembled to each other along their juxtaposed matching edges 155. Such edge-to-edge union or assembly may be made by means of a suitable adhesive providing a fusion-like union or by means of heat-fusion (as, for instance, by microwave-heating of the edges) or by means of solvent-fusion which renders the synthetic-resin sufficiently adhesive to a suitable depth to permit the fusion of the walls along their juxtaposed matching edges.

Having shown and described embodiments of my invention, I claim the following:

1. A modular architectural-constructional toy and playground erector-set comprising a plurality of some of the below-described kinds of modules adapted to be optionally assembled into various horizontal and vertical and angular structures by various combinations thereof, the modules having matching planar walls defining polyhedrons, which walls may be detachably secured to each other when in registration with each other, and fastening means associated with the juxtaposed matching walls of adjacent modules for detachably securing them in non-rotable orientation to each other with their juxtaposed walls in registration and in contact with each other, some of the walls of each module matching some of the walls of another module and the matching walls of adjacent modules being adapted to operatively juxtaposed to and to be in matching contact with each other when assembled to each other to form the aforementioned structures, and a plurality of one of the below-described modules being adapted to form one of the below-described derivative modules composed thereof:

(P) a Primary tetrahedron module P having one wall A which is a right-angled isosceles triangle whose angles are approximately 90°, 45° & 45°, respectively, having two walls B, each of which is a right-angled triangle whose angles are approximately 90°, 55° & 35°, and having one wall C which is an isosceles triangle whose angles are approximately 70°, 55°, & 55°, (S-1) a Secondary tetrahedron module S-1 derivable from two P modules by placing the A walls thereof in registration and in full contact with each other, having two C walls at approximately a right angle to each other which are the original C walls of two P modules or the equivalents thereof (hereinafter designated as the oC walls), and having two C walls at approximately a right angle to each other, each of which is composed or the equivalent of two coplanar B walls of opposite P modules (hereinafter designated as dC walls), each dC wall being at approximately a 60° included angle to an adjacent oC wall, (S-2) a Secondary tetrahedron module S-2 derivable from two P modules by placing in registration and in full contact with each other one B wall of one P module and one B wall of the other P module, such S-2 module having a triangular D wall composed or the equivalent of two coplanar A walls, the angles of such triangular D walls being approximately at 90°, 45° & 45°, having two C walls which are the same as or the equivalents of the two oC walls of the two P modules, and having one E wall which is an isosceles triangle composed or the equivalent of two B walls with their shortest boundary-lines adjacent to each other, the angles of such triangular E wall being approximately 110°, 35° & 35°, (S-3) a Secondary hexahedron module S-3 derivable from two P modules by placing the two C walls in registration and in full contact with each other, and having two A walls at approximately a right angle to each other along their hypothenuses, and having four B walls, with one pair of adjacent B walls each at approximately a right angle to one of the A walls and with the opposite pair of B walls at approximately a right angle to the other A wall, and having the adjacent B walls on opposite sides of the plane of the C walls at approximately 120° to each other, (T-1) a Tertiary pentahedron module T-1 derivably by placing any C wall (an oc wall or a dC wall) of one S-1 module in registration and in full contact with any C wall of the other S-1 module having a rhombus-shaped F wall composed or the equivalent of four coplanar B walls or two coplanar C walls, and having four C walls, each at approximately 60° to the plane of the F wall and two of each pair of C walls being at approximately a right angle to each other and two of each pair of each differently paired C walls being at approximately 120° to each other, (T-2) a Tertiary pentahedron module T-2 derivable by placing the E walls of two S-2 modules in registration and full contact with the other, having one square G wall composed or the equivalent of four coplanar A walls, and having four C walls each at approximately 45° to the G wall and each at approximately 120° to its adjacent G wall, (T-3) a Tertiary septahedron module T-3 derivable from S-3 modules by placing two A walls thereof in registration and in full contact with each other, having one square H wall which is composed or equivalent to the two coplanar A walls, and having four B walls approximately at right angles to each other, and having two C walls approximately at 90° to each other, and each C wall being approximately at 120° to the adjacent B walls.

2. A modular architectural-constructional erector-set according to claim 1, in which the modules are formed of a suitably resilient though generally form-retaining synthetic-resin plastic.

3. A modular architectural-constructional erector-set educational toy according to claim 1, in which the modules are solid.

4. A modular architectural-constructional erector-set according to claim 1, in which the modules are hollow.

5. A modular architectural-constructional erector-set educational toy according to claim 1, having recesses in and matching connector-projections on the faces thereof, so arranged that when two like wall-surfaces of two modules are juxtaposed to and in registration with each other the projections on one of the two registering wall-surfaces enter the recesses in the other of the two registering wall-surfaces with sufficient interference-fit between the recesses and projections that they form a detachable connection between the modules.

6. A modular architectural-constructional erector-set according to claim 1, including several different sizes of at least some of the same modules, with the different sizes of the same module being integral multiples or fractions of one another so that the like wall-surfaces of several of the smaller-size modules will register with a like wall-surface of a next larger size module.

7. A modular architectural-constructional erector-set according to claim 4, in which some of the walls of some of the modules are fenestrated so as to leave behind relatively narrow marginal wall-flanges flanking the fenestra.

8. A modular architectural-constructional erector-set according to claim 7 in which wall-webs extend from wall-flanges in co-planar relationship therewith.

9. A modular architectural-constructional erector-set according to claim 7 in which at least some of the walls of the modules are fenestrated by several fenestrae so as to leave behind relatively narrow marginal wall flanges along the border of the wall and wall-webs intervening such flanges co-planar therewith.

10. Modular architectural-constructional erector-set playground equipment according to claim 1, in which at least some of the modules are hollow and are bounded by relatively thin walls at least some of which are fenestrated.

11. Modular architectural-constructional erector-set playground equipment according to claim 10, in which the modules are formed of a relatively light-weight, form-retaining and impact-resistant synthetic-resin plastic.

12. Modular architectural-constructional erector-set playground equipment according to claim 10, in which the fenestrations are relatively large so as to leave behind relatively narrow wall-flanges defining the wall of the module.

13. Modular architectural-constructional erector-set playground equipment according to claim 10, in which the walls have matching fastener-receiving holes therein, and including quick-attachable and quick-detachable fasteners extending through registering holes in registering walls of two modules for detachably securing them to each other.

14. Modular architectural-constructional erector-set playground equipment according to claim 1, in which the modules are hollow and are bounded by relatively light-weight form-retaining and impact-resistant synthetic-resin-plastic walls at least some of which are fenestrated, and in which the core portions of said walls are expanded-cellular synthetic-resin-plastic of low density and in which the surface-portions of said walls are of higher density impact-resistant non-cellular synthetic-resin-plastic.

15. A modular architectural-constructional erector-set educational toy according to claim 5, in which the recesses and connector-projections are non-circular in cross-section.

16. A modular architectural-constructional erector-set educational toy according to claim 5, in which the recesses and connector-projections are polygonal in cross-section.

17. A modular architectural-constructional erector-set according to claim 1, in which the modules are hollow and in which at least some of the walls or at least some of the modules are fenestrated so as to leave behind relatively narrow marginal wall flanges bordering the fenestra, and including corner-webs intermediate the junctures of said wall-flanges.

18. A modular architectural constructional erector-set according to claim 17, including fastener-receiving holes in walls of the module.

19. A separate architectural-constructional erector-set module of tetrahedron configuration and devoid of any permanent connection with another module, and having one wall which is an isosceles triangle whose angles are approximately 90°, 45° 45°, respectively, and having two triangular walls whose angles are approximately 90°, 55° & 35°, and having one wall which is an isosceles triangle whose angles are approximately 70°, 55° & 55°, and fastening means associated with walls thereof for detachably securing juxtaposed matching walls of two of said modules in registration and contact with each other.

20. An architectural-constructional erector-set module according to claim 19, formed of a suitably resilient form-retaining synthetic-resin plastic.

21. A module according to claim 20, in which the module is hollow.

22. A module according to claim 21, in which at least some of the walls of the module are fenestrated.

23. A separate architectural-constructional erector-set module of tetrahedron configuration and devoid of any permanent connection with another module, and having four isosceles-triangular walls paired differently in two different pairings thereof, the angles of each of said triangles being approximately 70°, 55° & 55°, and paired one way the two walls of each pair being at approximately 90° to each other and paired the other way the two walls of each pair being at approximately 60° to each other, and fastening means associated with walls thereof for detachably securing juxtaposed matching walls of two of said modules in registration and contact with each other.

24. An architectural-constructional erector-set module according to claim 23, formed of a suitably resilient form-retaining synthetic-resin plastic.

25. A module according to claim 24, in which the module is hollow.

26. A module according to claim 25, in which at least some of the walls of the module are fenestrated.

27. A separate architectural-constructional erector-set module of tetrahedron configuration and devoid of any permanent connection with another module, and having two walls each of which is an isosceles triangle whose angles are 70°, 55° & 55°, said two walls being disposed at approximately 120° to each other along one of their shortest boundary lines, and having one triangular wall whose angles arc 90°, 45° & 45°, and which wall is disposed at approximately 45° to each of the two aforementioned isosceles-triangular walls with the longest boundary lines of the isosceles-triangular walls being co-extensive with the two shorter boundary lines of this right-angles triangular wall, and having one isosceles-triangular wall whose angles are approximately 110°, 35° & 35°, this wall being disposed at approximately 90° to the aforementioned right-angles triangular-wall and at approximately 60° to each of the aforementioned isosceles-triangular walls, and fastening means associated with walls thereof for detachably securing juxtaposed matching walls of two of said modules in registration and contact with each other.

28. An architectural-constructional erector-set module according to claim 27, formed of a suitably resilient form-retaining synthetic-resin plastic.

29. A module according to claim 18, in which the module is hollow.

30. A module according to claim 29, in which at least some of the walls of the module are fenestrated.

31. A separate architectural-constructional erector-set module of hexahedron configuration and devoid of any permanent connection with another module, and having a pair of triangular walls whose angles are approximately 90°, 45° & 45° and which walls are disposed at approximately 90° to each other along their hypothenuses, and having four smaller triangular walls whose angles are approximately 90°, 55° & 35°, said four smaller walls being paired in each of two different pairings, namely, in two pairs in which the two walls of each pair are at approximately 120° to the other along their hypothenuses and in two pairs in which the two walls of each pair are at approximately 90° to each other, and two walls of the latter pairs being at approximately 90° to each other, and two walls of the latter pairs being at approximately 90° to one of the first-mentioned right-angled triangular walls and two of said walls being at approximately 90° to the other of the first-mentioned right-angled triangular walls, and fastening means associated with walls thereof for detachable securing juxtaposed matching walls of two of said modules in registration and contact with each other.

32. An architectural and constructional erector-set module according to claim 31, formed of a suitably resilient form-retaining synthetic-resin plastic.

33. A module according to claim 32, in which the module is hollow.

34. A module according to claim 33, in which at least some of the walls of the module are fenestrated.

35. A separate architectural-constructional erector-set module of pentahedron configuration and devoid of any permanent connection with another module, and having one equilateral rhombus-shaped wall one of whose diagonally opposite pairs of corners are each 70° and whose other diagonally opposite pairs of corners are each 110°, and having four like walls each of which is an isosceles triangle whose angles are approximately 70°, 55° & 55°, each of said triangular walls being at approximately 90° to one other of said triangular walls along their longest boundary lines and being at approximately 120° to one other of said walls along one of their shorter boundary lines, and fastening means associated with walls thereof for detachably securing juxtaposed matching walls of two of said modules in registration and contact with each other.

36. An architectural and constructional erector-set module according to claim 35, formed of a suitably resilient form-retaining synthetic-resin plastic.

37. A module according to claim 36, in which the module is hollow.

38. A module according to claim 37, in which at least some of the walls of the module are fenestrated.

39. A separate architectural-constructional erector-set module of pentahedron configuration and devoid of any permanent connection with another module, and having one square wall, and having four isosceles triangular walls each at approximately 45° to the said square wall along the longest boundary lines of said triangular walls and each of said triangular walls being at approximately 120° to each of two adjacent triangular walls along their shorter boundary lines, and fastening means associated with walls thereof for detachably securing juxtaposed matching walls of two of said modules in registration and contact with each other.

40. An architectural and constructional erector-set module according to claim 39, formed of a suitably resilient form-retaining synthetic-resin plastic.

41. A module according to claim 40, in which the module is hollow.

42. A module according to claim 41, in which at least some of the walls of the module are fenestrated.

43. A separate architectural-constructional erector-set module of septahedron configuration and devoid of any permanent connection with any other module, and having one square wall, and having four triangular walls whose angles are approximately 90°, 55° & 35° and each of which is at approximately 90° to said square wall along the longer of its two right-angular boundary-lines, and each of said triangular walls is at approximately 90° to two adjacent ones of them, and having two isosceles triangular walls at approximately 90° to each other and each at approximately 120° to two of the first-mentioned triangular walls, the angles of each of said isosceles triangles being approximately 70°, 55° & 55°, and fastening means associated with walls thereof for detachably securing juxtaposed matching walls of two of said modules in registration and contact with each other.

44. An architectural and constructional erector-set module according to claim 43, formed of a suitably resilient form-retaining synthetic-resin plastic.

45. A module according to claim 44, in which the module is hollow.

46. A module according to claim 45, in which at least some of the walls of the module are fenestrated.

* * * * *